United States Patent [19]

Whitecar

[11] 3,970,120

[45] July 20, 1976

[54] FILLING MACHINE

[75] Inventor: Alten E. Whitecar, Westville, N.J.

[73] Assignee: SmithKline Corporation, Philadelphia, Pa.

[22] Filed: Dec. 20, 1974

[21] Appl. No.: 535,106

[52] U.S. Cl. ..... 141/1 R; 141/130; 141/191; 23/253 R; 23/259; 195/139; 417/476

[51] Int. Cl.[2] ..... B65B 3/04

[58] Field of Search ..... 23/253, 259; 195/139; 141/130–137, 183–191, 1, 101; 417/474, 476

[56] References Cited

UNITED STATES PATENTS 1,146,402 7/1915 Chambers ..... 141/130

3,280,762 10/1966 Shelly ..... 141/137

*Primary Examiner*—Houston S. Bell, Jr.

*Attorney, Agent, or Firm*—Smith, Harding, Early & Follmer

[57] ABSTRACT

A machine for filling bodies having elongated cavities such as culture medium paddles has a ring for supporting a plurality of bodies, means to continuously rotate the ring, filling means to deliver a liquid culture medium to a cavity on one side of the body, means to turn the body over to expose a second cavity, and second filling means to deliver a liquid culture medium to the second cavity.

31 Claims, 50 Drawing Figures

672
674
668
666
663
102
658
662
660
630
416
468
640
636
634
638
482
480
642
655
644
34
670
30
31
642'
658'
646
648
649
647
650
651
653
652
657A
488

1064
1066
1068
1072
1082
1069
1080
1087
1092
1086
1073
1074
1088
1082

102
20
6
39
1132
1008
1118
1134
1038
1136
1140
1142
1060
1144
1146
34
1148
1052
1050
1054
1062
1064
1056
1092
1066
1068
1088
1108
1110
1080
1069
1087
1102
1100
1104
1106
1114

1118
1132
1038
1134
1140
1142
1060
1144
1146
1050
1148
1110
1054
6

FILLING MACHINE

BACKGROUND OF THE INVENTION

The hand filling of paddle cavities is a difficult operation particularly as in the case of culture paddles where the cavities are shallow and must be substantially completely filled with a liquid culture medium. Such culture paddles are used to culture microorganisms obtained from a patient's body as seen in U.S. Pat. No. 3,616,265 which is incorporated herein by reference. Typically, a culture medium is a liquid at elevated temperature and solidifies at room temperature rapidly. The operation is further complicated by the necessity in some cases of filling cavities on two opposite sides of a culture paddle. Also, further complexity is frequently involved where it is necessary to mix an additional ingredient such as, for example, blood with the culture medium immediately before filling the paddles. This invention provides an efficient machine for solving these problems and similar problems in connection with filling other bodies with elongated cavities.

Peristaltic pumps employing one or more resilient tubes and reciprocating rollers are known to the art for the sterile filling of ampuls. Conveyor wheels which are operated in step fashion in filling machines are also known to the art.

SUMMARY OF THE INVENTION

A machine for filling elongated cavities with a liquid has a ring for supporting a plurality of bodies having cavities and means to continuously rotate the ring. Filling means delivers a liquid to the cavity of each body on the ring. The filling means includes means to follow one or more bodies as they are advanced by the ring and then to return to the original position for filling the cavity of the next body or bodies as well as means to spread the liquid evenly throughout the cavity by causing the filling means to travel the length of the cavity during the filling operation. The lower end of the filling means is placed close to the cavity during the filling. Advantageously, the invention includes means to turn over the body and a second filling means to fill a second cavity on the second side of each body. In addition, the invention includes, for use when desired, means to mix two liquids to be used for the filling operations. A purging system pumps liquid through the filling means when normal operation is suspended to prevent the liquid from solidifying in the filling means and to assist in start up of the machine.

DETAILED DESCRIPTION

Figure 3:
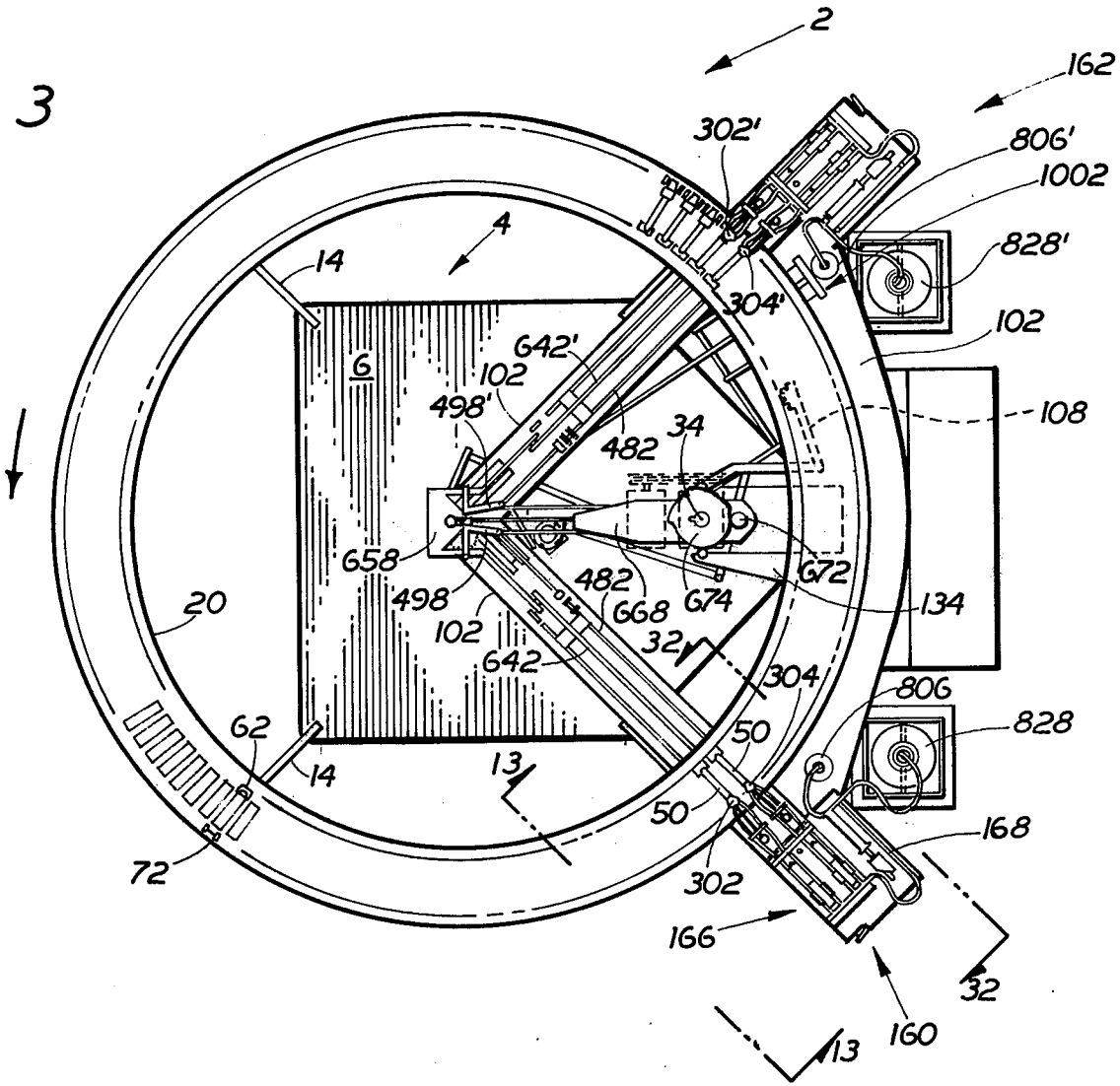
FIG. 3 is a top plan view of a machine in accordance with the invention.
Figure 4:
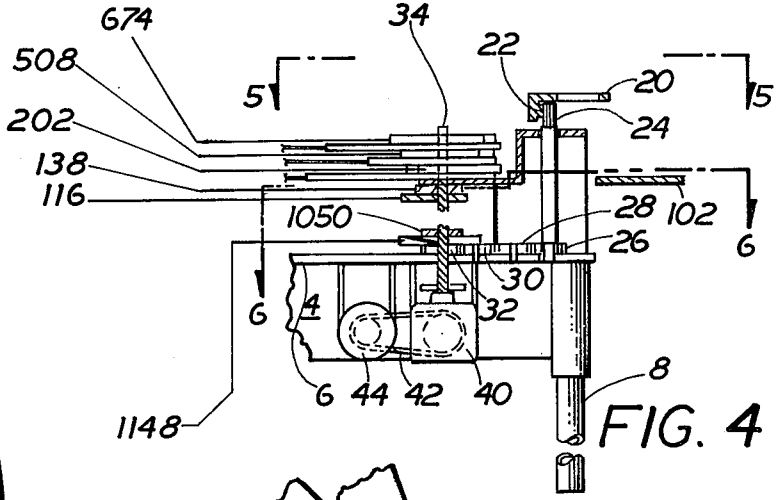
FIG. 4 is an elevational view, partially broken away, showing the motor drive and principal cam shaft of the machine of FIG. 3.
Figure 5:
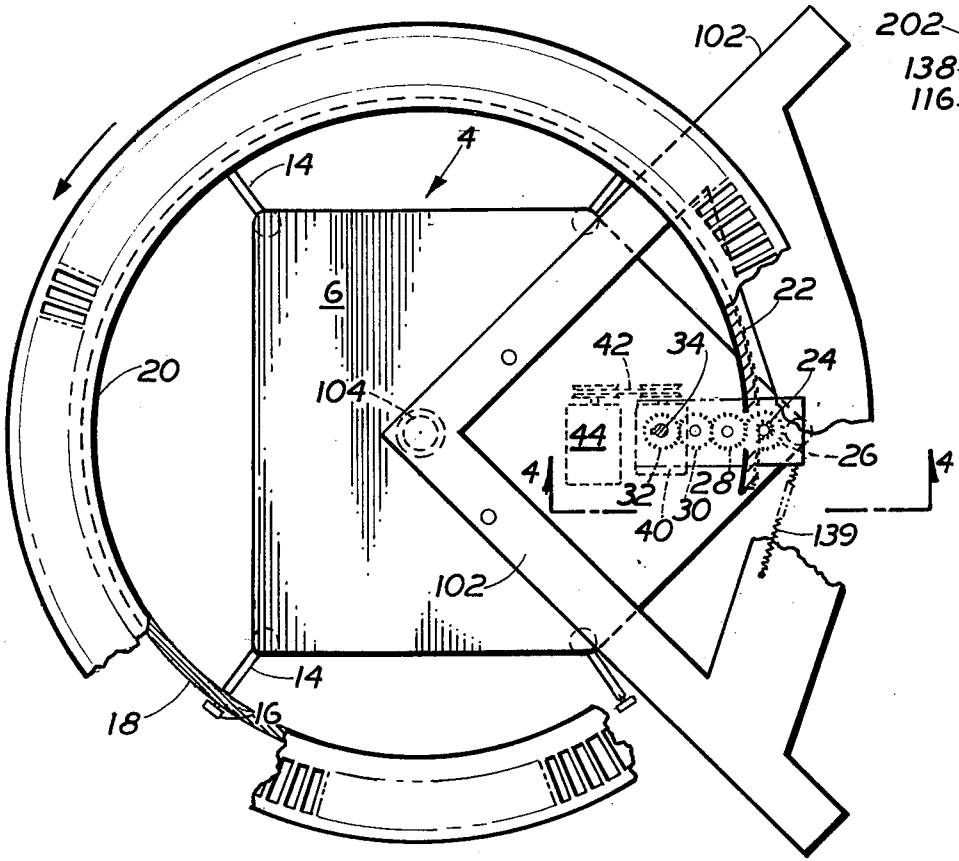
FIG. 5 is a top plan view of the machine of the invention, partially broken away, and omitting mechanisms in order to show in detail the oscillating frame of the machine of FIG. 3.
Figure 7:
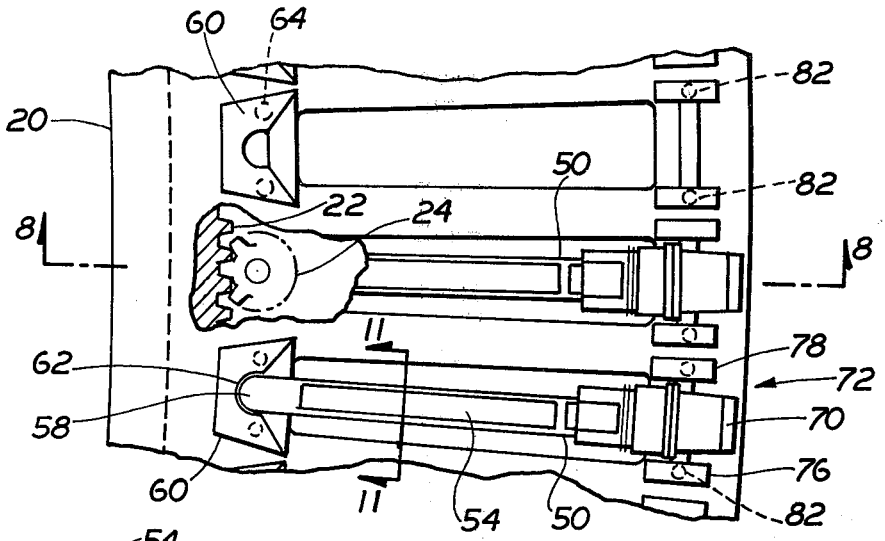
FIG. 7 is a top plan view, partially broken away, of the ring of the machine of FIG. 3 showing the support of paddles and the ring drive.
Figure 8:
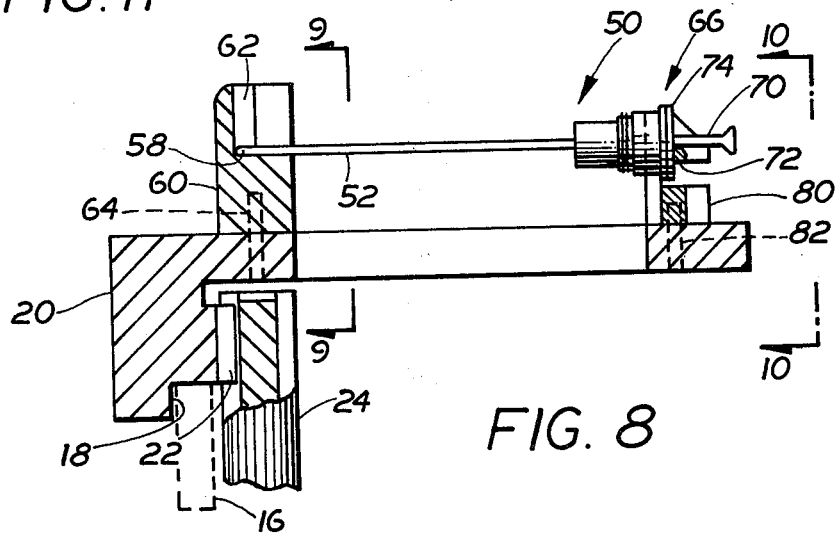
FIG. 8 is a vertical section through the paddle support structure shown in FIG. 7 taken on line 8—8 in FIG. 7.
Figure 9:
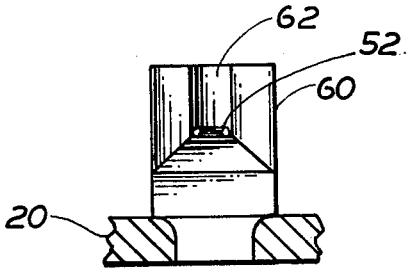
FIG. 9 is a vertical section taken on the plane indicated by the line 9—9 in FIG. 8.

A filling machine 2 (FIG. 3) has a box support frame 4 having a top plate 6 and mounted on a plurality of standards 8 (FIG. 4). A plurality of arms 14 secured to frame 4 each carry a roller 16 (FIG. 5). A ring 20 is mounted for rotation on rollers 16 as best seen in FIG. 5. A peripheral flange 18 on ring 20 is adjacent rollers 16 insuring centering of ring 20 as best seen in FIG. 8 where a roller 16 is shown in phantom to indicate that this is not the precise angular location of a roller 16 but illustrates the relationship between roller 16 and ring 20. As best seen in FIGS. 4, 5 and 7 ring 20 has a ring gear 22 which is engaged by a pinion 24 which has a gear 26 secured to its lower end (FIG. 4). Gear 26 is driven by a gear 28 (see FIGS. 4 and 5) which is driven by a gear 30 which in turn is driven by a gear 32 which is secured to a shaft 34. Shaft 34 is driven by a speed reducer 40 which is driven by a belt 42 connected to an electric motor shown at 44. In this manner ring 20 is continuously rotated when machine 2 is in operation.

Figure 11:
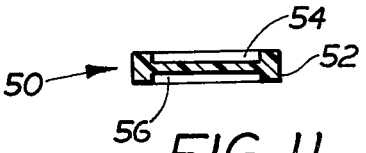
FIG. 11 is a vertical section through a paddle taken on the plane indicated by the line 11—11 in FIG. 7.

Ring 20 is adapted to carry culture paddles 50 which are best seen in FIGS. 7, 8 and 11 and are circumferentially arranged around ring 20 as shown in FIG. 3. Each culture paddle 50 has a blade 52 with an elongated recess 54 on one side and a companion elongated recess 56 on the other side, each of which is adapted to hold a culture medium. The tip end 58 of each paddle is supported by a block 60 which has a cutout portion 62 for the reception of the tip end 58 and is secured to ring 20 by pins 64 (FIG. 8). The head end 66 of paddle 50 which is adapted to be inserted into a protective tube (not shown) has a flat handle 70 which is supported on a bar support member shown at 72 which also abuts against the top 74 of head end 66. Member 72 is secured to blocks 76 and 78 which also act to restrain the sidewise movement of head end 66. Blocks 76 and 78 are integral with a block 80 which in turn is secured to ring 20 by pins indicated at 82 (FIG. 8).

An oscillating frame 102 (FIG. 5) is pivotally mounted below ring 20 on a shaft 104 which is secured to plate 6. A lever 108 (FIG. 6) is pivotally connected at 110 to frame 102 and is provided with teeth 112 which are adapted to engage ring gear 22. Lever 108 has a cam follower 114 which is urged against cam 116 on shaft 34 by means of an extension coil spring 120 which is connected to an extension member 122 secured to lever 108 and urges lever 108 to rotate counterclockwise as viewed in FIG. 6. The other end of spring 120 is connected to frame 102. An arm 134 is fixedly secured to frame 102 and carries a cam follower 136 which cooperates with cam 138 secured to shaft 34. An extension coil spring 139 biases frame 102 counterclockwise as viewed in FIG. 5 causing frame 102 to follow ring 20 to permit teeth 112 of lever 108 to be urged into engagement with ring gear 22 by spring 120 to cause frame 102 to move in unison with ring 20 counterclockwise as viewed in FIG. 5; and cam 138 through cam follower 136 and arm 134 acts to return frame 102 to its original position when cam 116 disengages teeth 112 of lever 108 from ring gear 22. Cam 138 is shaped to permit the advance of frame 102 when teeth 112 are in engagement with gear 22.

All parts of machine 2 are shown in the drawings in the position they occupy at the beginning of a cycle of operation (referred to herein as neutral) which results in the filling of the cavities of a culture paddle.

Machine 2 has a pair of pumping stations 160 and 162 (FIG. 3). Since the pumping station 162 is a mirror image of the pumping station 160 only the latter will be described in detail, with the corresponding parts of pumping station 162 which are shown being given corresponding prime numbers.

Figure 13:
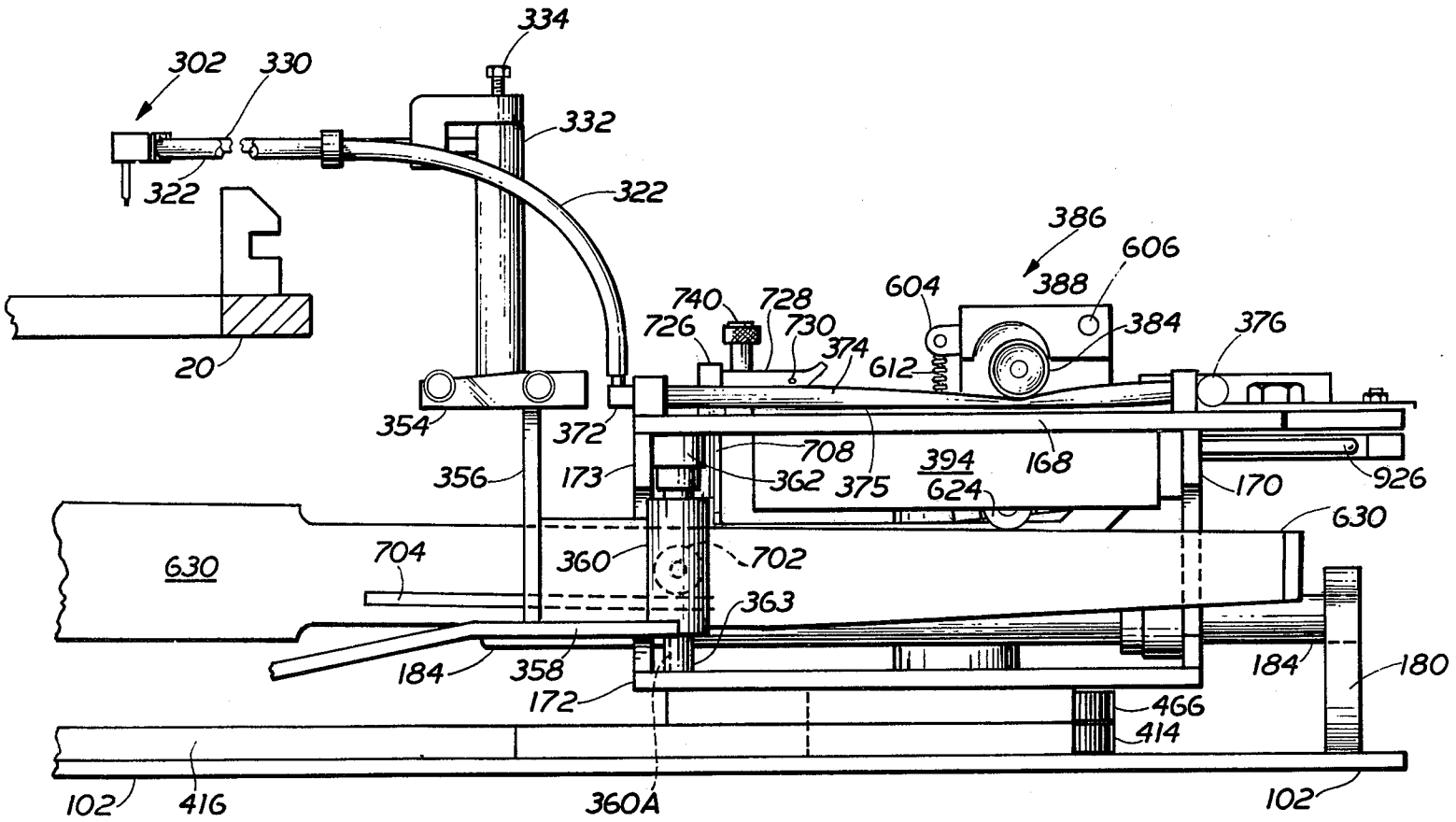
FIG. 13 is a left side elevation of the pumping station of FIG. 12.
Figure 13A:
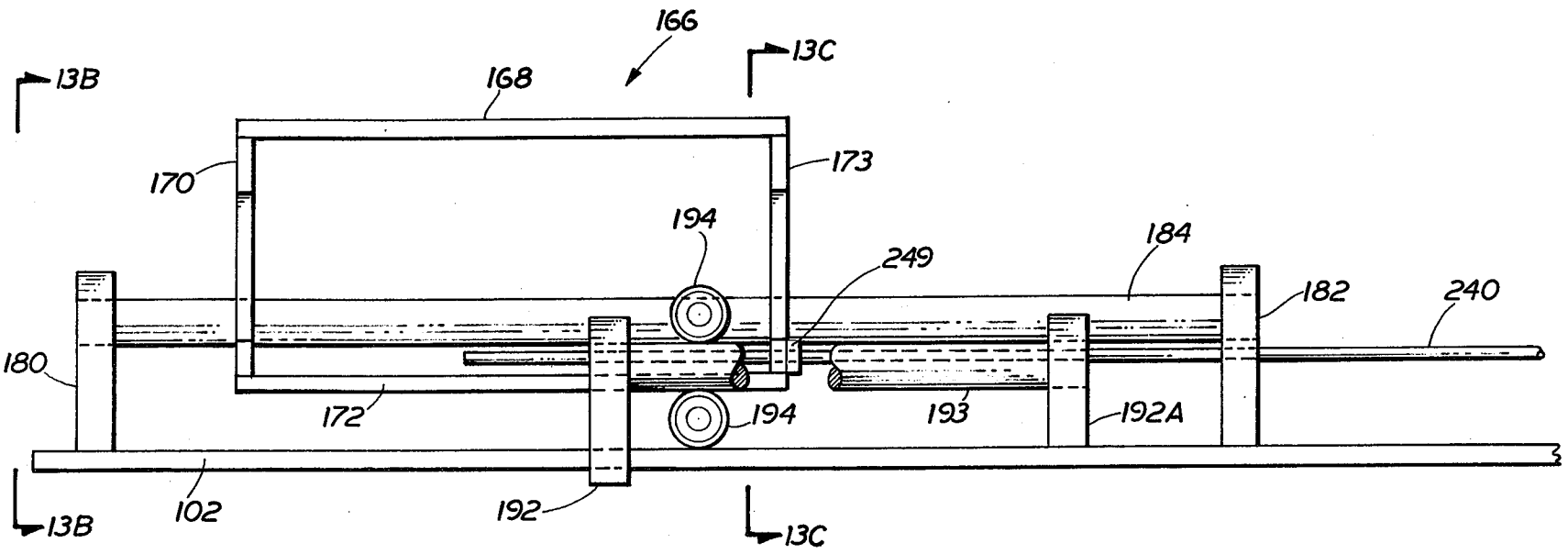
FIG. 13A is a right side elevation of the frame of the pumping station carriage and its mounting.
Figure 13B:
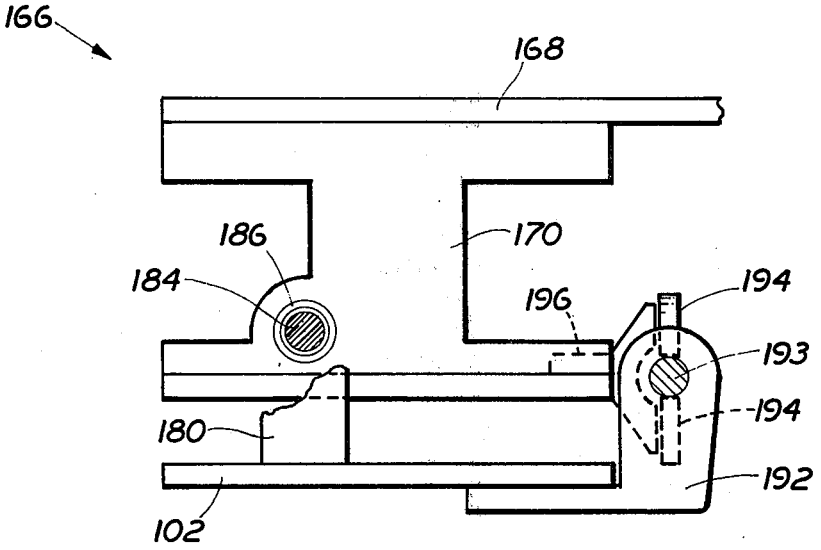
FIG. 13B is an elevational view of the structure of FIG. 13A taken on the plane indicated by the line 13B—13B in FIG. 13A.
Figure 13C:
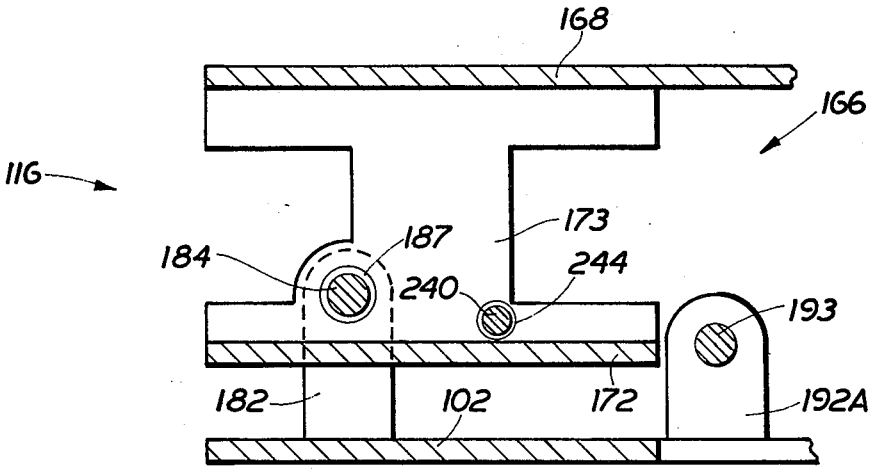
FIG. 13C is an elevational view of the structure of FIG. 13A taken on the plane indicated by the line 13C—13C in FIG. 13A.
Figure 23:
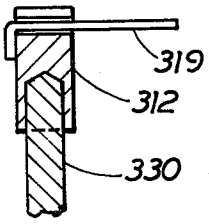
FIG. 23 is a section taken on the plane indicated by the line 23—23 in FIG. 21.
Figures 23A, 23B:
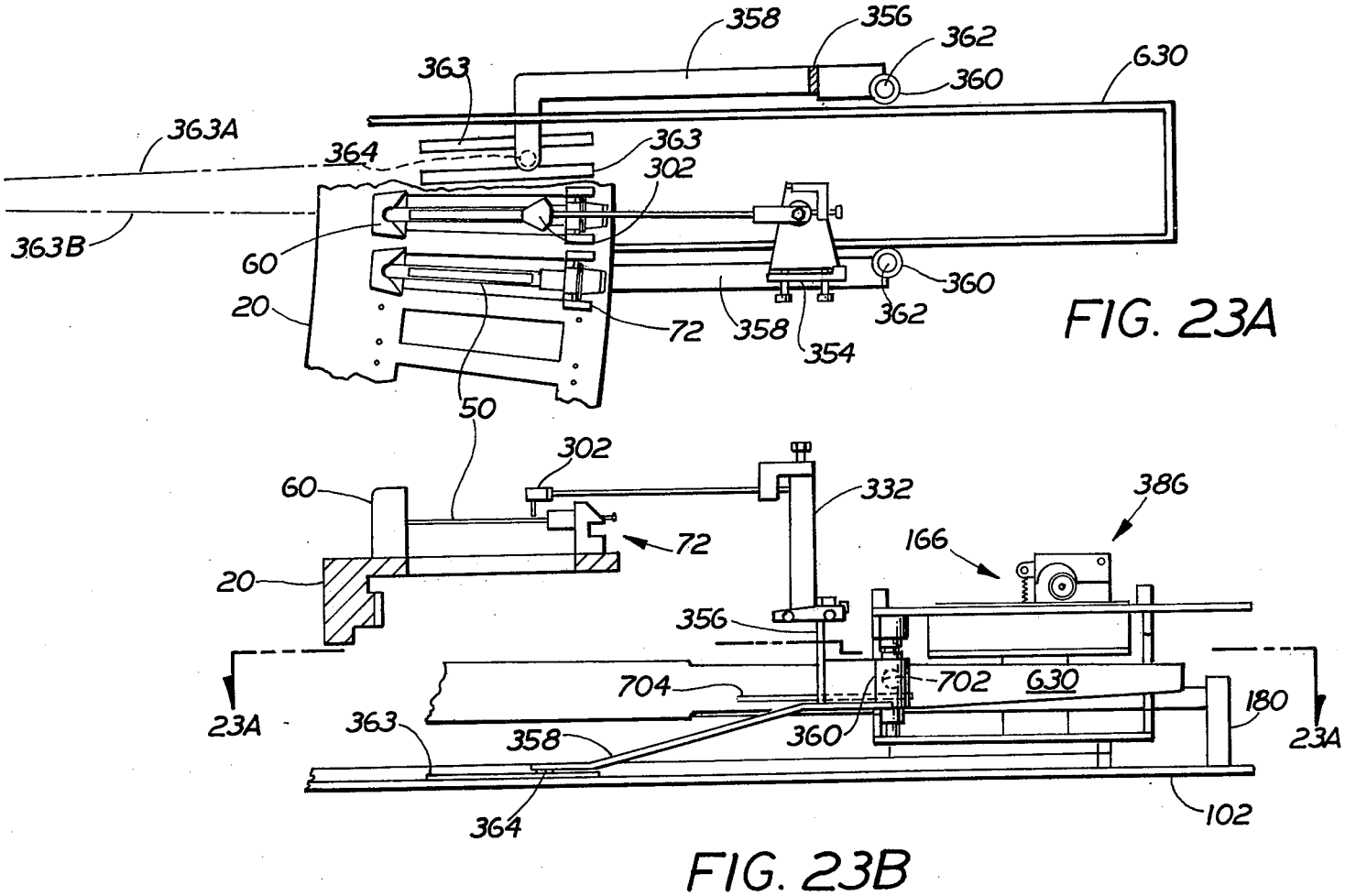
FIG. 23A is a plan view partially broken away showing the mechanism for correcting the paths followed by the fluid delivery mechanisms.
FIG. 23B is a side elevation of parts of the path correcting mechanism of FIG. 23A.
Figure 23C:
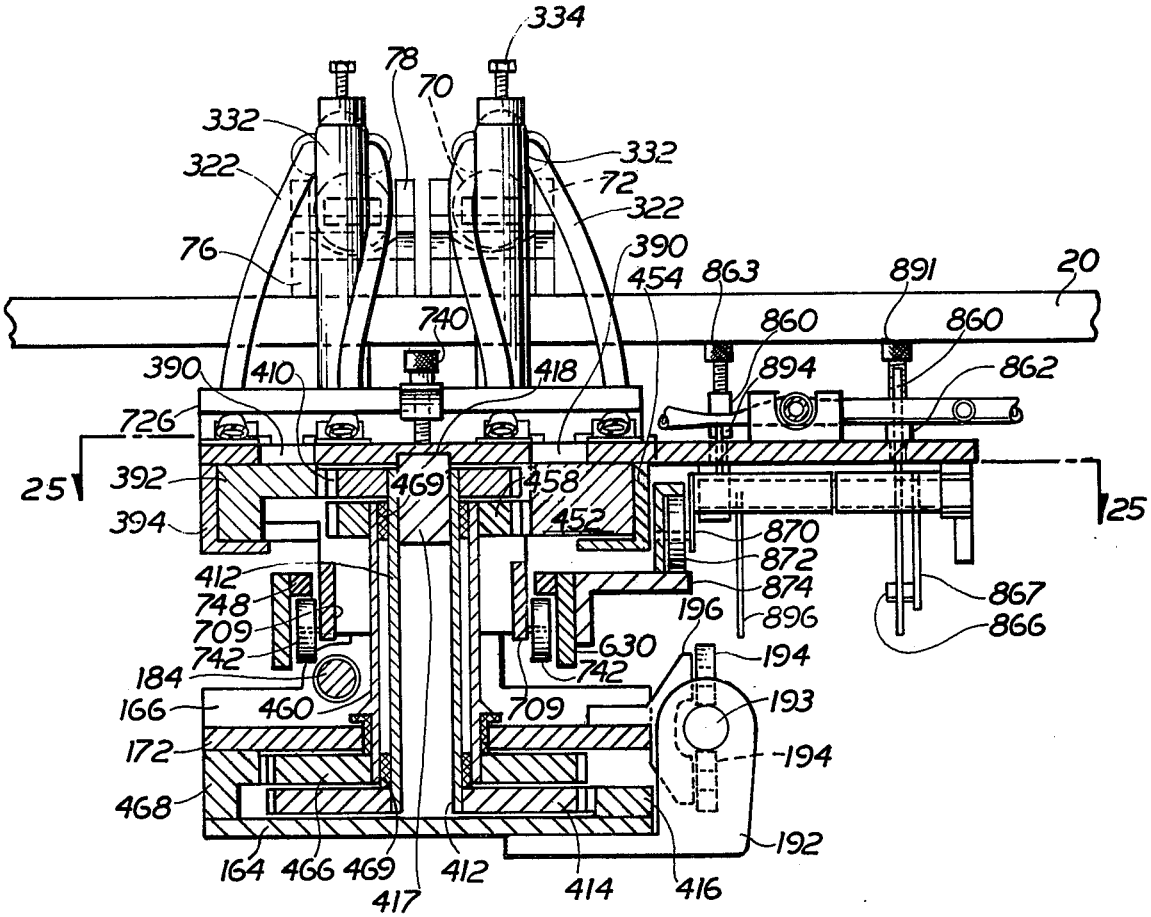
FIG. 23C is a vertical section through the pumping station carriage taken on the plane indicated by the line 23C—23C in FIG. 12.

Pumping station 160 has a reciprocating carriage 166 with a top plate 168, a rear plate 170 (FIGS. 13 and 13A), a bottom plate 172 and a front plate 173. A pair of standards 180 and 182 (FIGS. 13 and 13A) are mounted on frame 102 and carry a rod 184 which is engaged by a bushing 186 fixedly secured to wall 170 (FIG. 13B) and a bushing 187 secured to wall 173 (FIG. 13C). A pair of brackets 192, 192A (FIGS. 13B and 13C) secured to frame 102 support a rod 193 engaged by rollers 194, 194 carried by a bracket 196 (FIG. 23C) secured to carriage 166 (FIGS. 13B and 23C). In this manner the carriage 166 is mounted for sliding towards and away from ring 20 on a radial of ring 20.

RECIPROCAL MOVEMENT OF CARRIAGE

Figure 16:
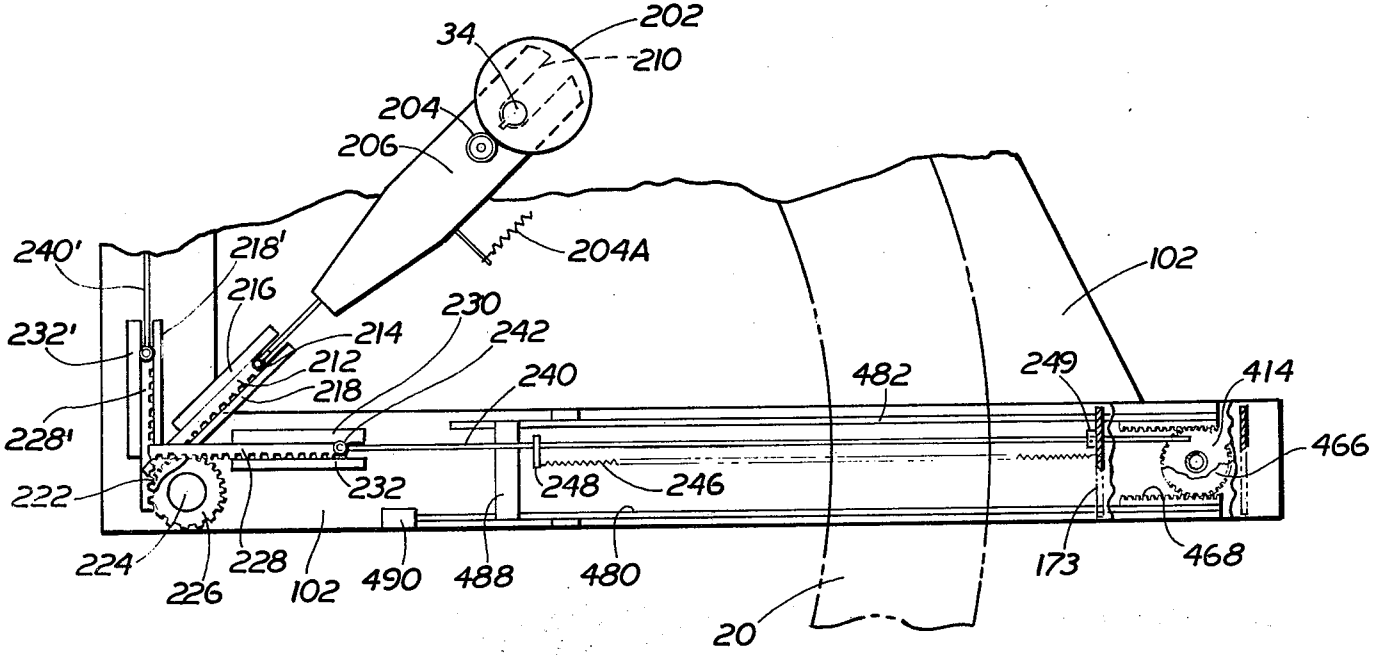
FIG. 16 is a plan view of the mechanism employed to reciprocate the carriage employed in the pumping station of FIG. 12.

Reciprocal movement of carriage 166 is provided by the mechanism now to be described and best seen in FIG. 16. A cam 202 secured to shaft 34 is engaged by a cam follower 204 on shaft 34. An extension spring 204A biases follower 204 against cam 202. Arm 206 is connected to a rack 212 as indicated at 214, the rack being guided by blocks 216 and 218. Rack 212 engages gear 222 which is secured to rotatable shaft 224. Shaft 224 is secured to a gear 226 which engages a rack 228 guided by blocks 230 and 232. Rack 228 is connected to a rod 240 as indicated at 242. Rod 240 passes freely through an opening 244 in wall 173 (FIG. 13C) of carriage 166. A stiff extension spring 246 has one end secured to wall 173 of carriage 166 and the other end fixedly secured to rod 240 at pin 248. Spring 246 is such that carriage 166 is urged against a stop collar 249 on rod 240 and follows the movement of rod 240 unless there is a jam resisting carriage movement, i.e. spring 246 acts normally as a fixed connection between rod 240 and carriage 166.

Figure 19:
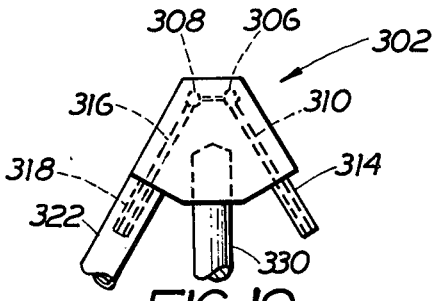
FIG. 19 is a plan view of a portion of the structure of FIG. 17.
Figure 21:
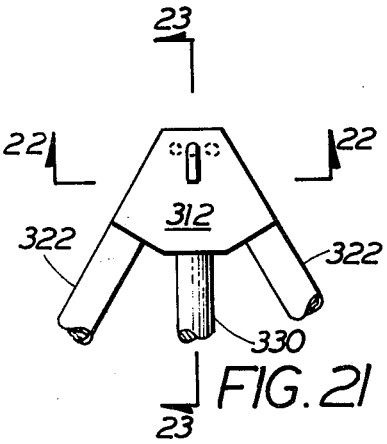
FIG. 21 is a plan view of an alternative nozzle structure.
Figure 20:
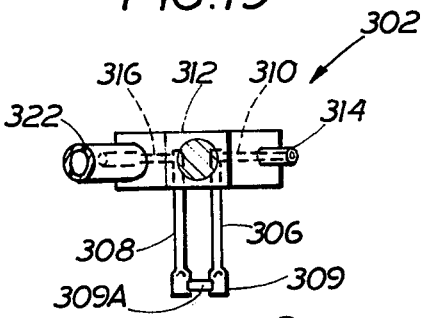
FIG. 20 is a view taken on the plane indicated by the line 20—20 in FIG. 18.
Figure 22:
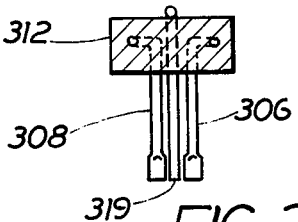
FIG. 22 is a vertical section taken on the plane indicated by the line 22—22 in FIG. 21.

The primary function of reciprocating carriage 166 is to reciprocate on a radial of ring 20 a pair of fluid discharge members 302 and 304 (FIG. 3) carried by carriage 166. Each of the fluid discharge members has a pair of discharge nozzles 306 and 308 (FIGS. 19 and 20). Each nozzle has a flattened end 309 (FIG. 20) providing a generally elliptical cross section to provide a wide fluid stream and is connected by a spreader bar 309A which acts to distribute the liquid culture medium in the paddle cavity. Nozzle 306 is connected to a passage 310 within a block 312 which in turn is connected to a pipe 314. Similarly, nozzle 308 is connected to a passage 316 in block 312 which is connected to a pipe 318. Alternatively in lieu of spreader bar 309A, a vertical spreader rod 319 between nozzles 306 and 308 and secured to block 312 may be employed (FIGS. 21, 22 and 23).

Figure 17:
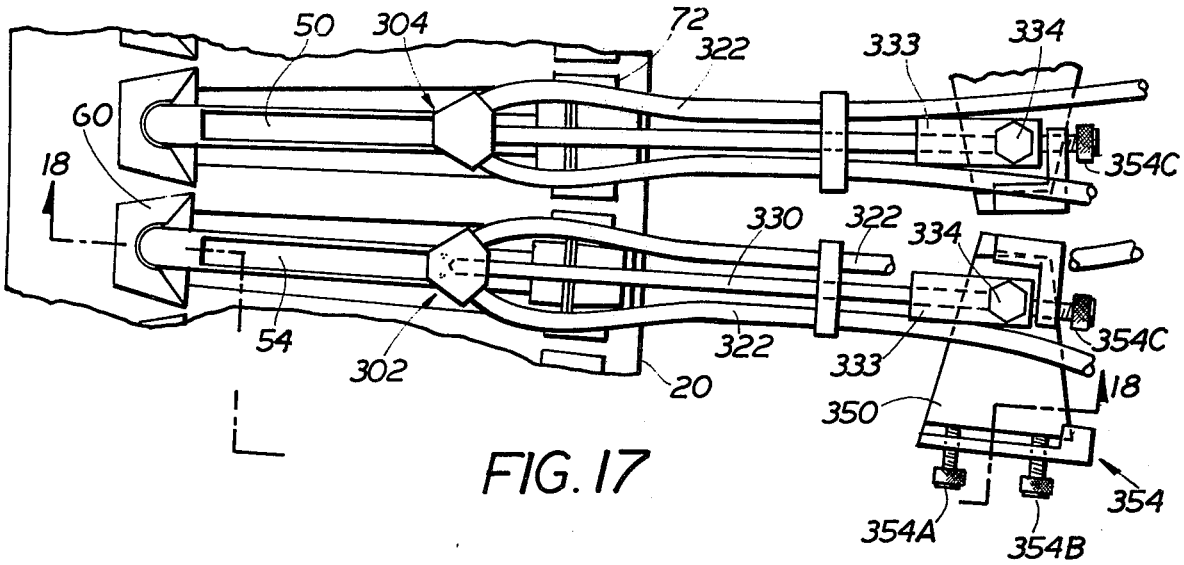
FIG. 17 is a plan view partially broken away of the nozzle arrangement of the machine of FIG. 3.
Figure 18:
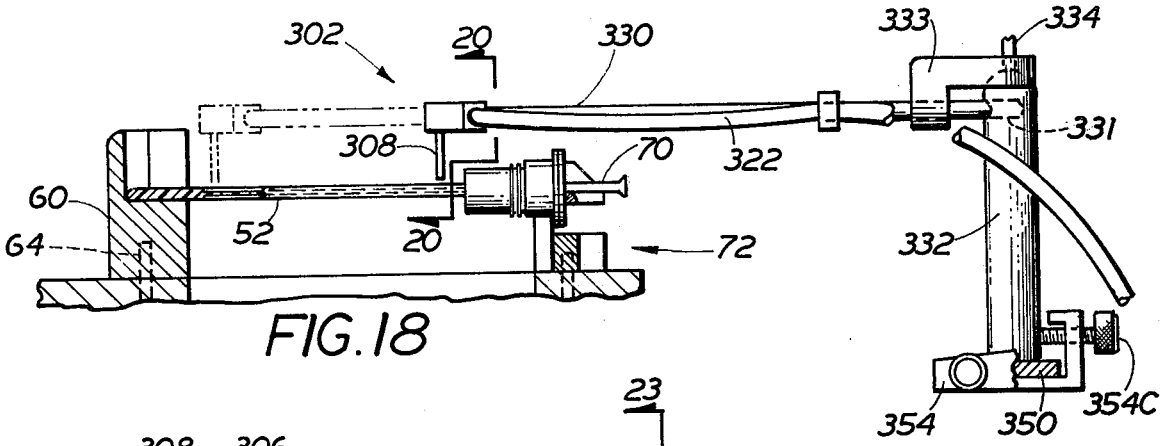
FIG. 18 is a view of the structure of FIG. 17 taken on the plane indicated by the line 18—18 in FIG. 17.

Each of pipes 314 and 318 is connected to a resilient tube 322 of, for example, rubber (FIG. 17). A rod 330 is connected to each block 312 and retained in an opening 331 in a standard 332 (FIG. 18). A lever arm 333 engages rod 330 and the top of standard 332 and is adjustable by screw 334 in standard 332 to bend rod 330 to adjust the height of nozzles 306 and 308 with respect to the paddle 50. Each standard 332 is mounted on a base 350 which is retained by a clamping member 354 (FIGS. 17 and 18) having clamping screws 354A and 354B engaging base 350 and a transverse clamping screw 354C to adjust the position of the nozzles 306 and 308 lengthwise of a paddle 50 (FIGS. 17 and 18).

Each clamp 354 is mounted on a standard 356 (FIG. 13) which in turn is secured to arm 358 rigidly connected to a member 360 mounted for rotation and vertical reciprocation in bearing member 362 connected to top plate 168 and bearing member 363 mounted in bottom plate 172 of carriage 166 which receives a reduced diameter end 360A of member 360.

Since the carriage 166 is reciprocated on a radial of ring 20 lying midway between two paddles 50, a correction is advantageously used to cause each fluid discharge member to track along the center line of its respective paddle. If only a single discharge member in lieu of a pair of discharge members is used the carriage is reciprocated on the radial containing the paddle being filled and no correction is used. With the two paddle embodiment described, the adjustment provides for better more even filling particularly with narrow cavities. To this end, each arm 358 has a follower 364 in a groove formed between two strips 363, 363 (FIGS. 23A and 23B) with the follower being directly below its corresponding fluid discharge member (302 or 304) with the center line of the groove lying in a vertical plane containing the center line of the respective paddle 50 (i.e., on the radial of ring 20 containing the paddle 50) causing the nozzles to track over the paddle 50 as the carriage 166 moves towards the ring 20.

The resilient tubes 322 are each connected to a fitting 372 (FIG. 13) on carriage plate 168 and each fitting 372 in turn is connected to a resilient tube 374 which runs above a narrow plate 375 on plate 168 back to a manifold 376 secured to bar 378 (FIG. 12) resting on carriage plate 168. Bar 378 has a slotted arm 380 engaged by screw 382 threadably secured to plate 168 to permit adjustment of the position of manifold 376. Manifold 376 is supplied with liquid culture medium in a manner to e described later.

Overlying each resilient tube 374 is a roller 384 connected to a reciprocating carrier 386 which carries two rollers 384 as detailed later. Each carrier 386 has a block 388 accommodated in a slot 390 in carriage top plate 168 (FIG. 14A).

Figure 14:
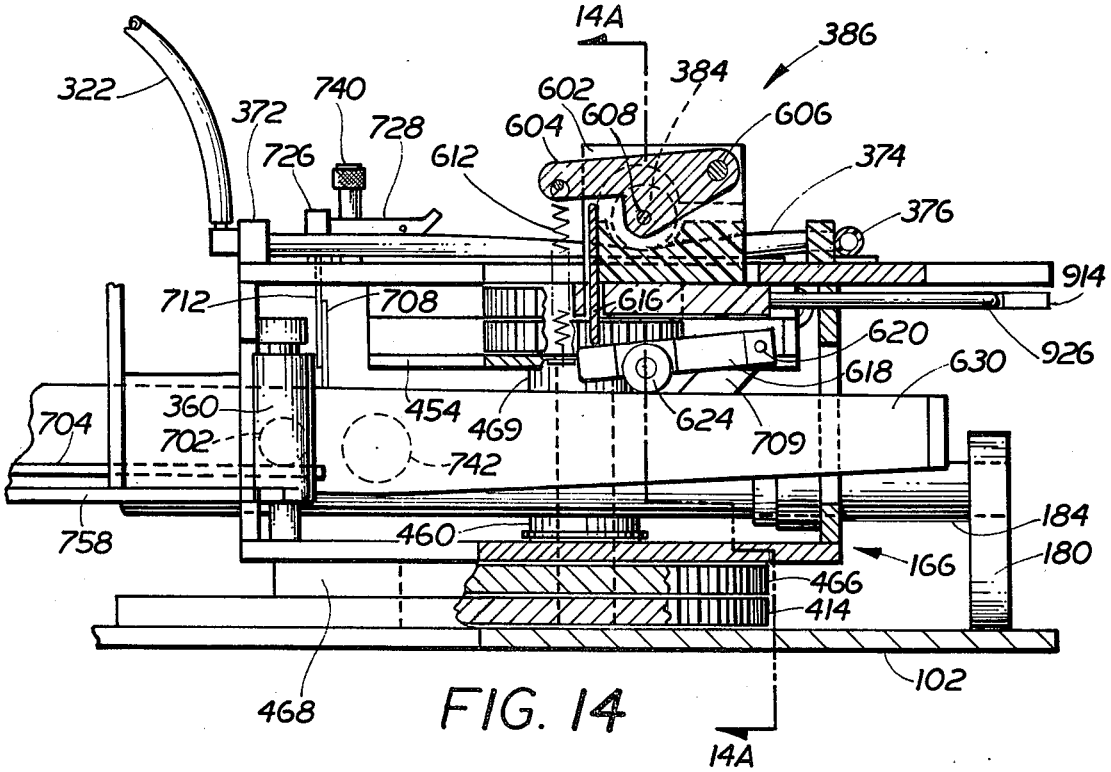
FIG. 14 is a section through the pumping station carriage partially broken away taken on the plane indicated by the line 14—14 in Fig. 12.
Figure 14A:
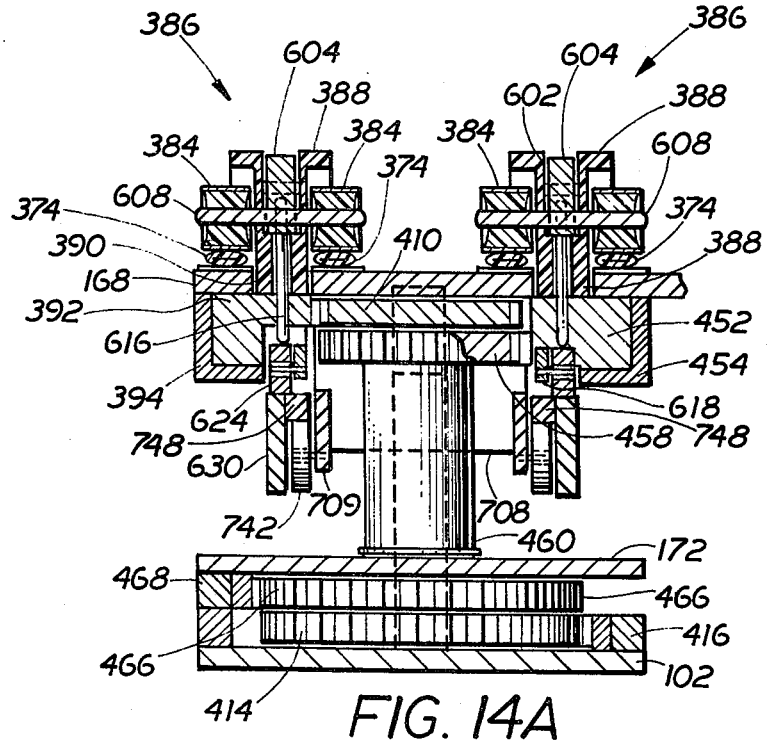
FIG. 14A is a vertical section through the structure of FIG. 14 taken on the plane indicated by the line 14A—14A in FIG. 14.

As best seen in FIG. 14A the left block 388 is fixedly secured to a rack 392 (by screws not shown) which slidably engages "L" support plate 394. Rack 392 is engaged by a gear 410 which as best seen in FIG. 23C is secured to sleeve 412 which in turn is fixedly secured to gear 414 which is driven by a rack 416. Sleeve 412 engages and rotates relative to a stub shaft 417 fixedly secured to carriage 166 at 418 (FIG. 23C).

Similarly, the right block 388 of the other carrier 386 is connected to a rack 452 by screws not shown (FIG. 14A) which slidably engages "L" support plate 454 and is engaged by gear 458 secured to sleeve 460 mounted for rotation about sleeve 412. Sleeve 460 is secured to a gear 466 which is engaged by a rack 468. Relative movement between rack 416 and gear 414 and relative movement between rack 468 and gear 466 results in the reciprocation of the two carriers 386, respectively, with respect to the carriage 166. Sleeves 412 and 460 are mounted with bushings 469, 469 between them so that they can rotate freely with respect to each other.

Figure 27:
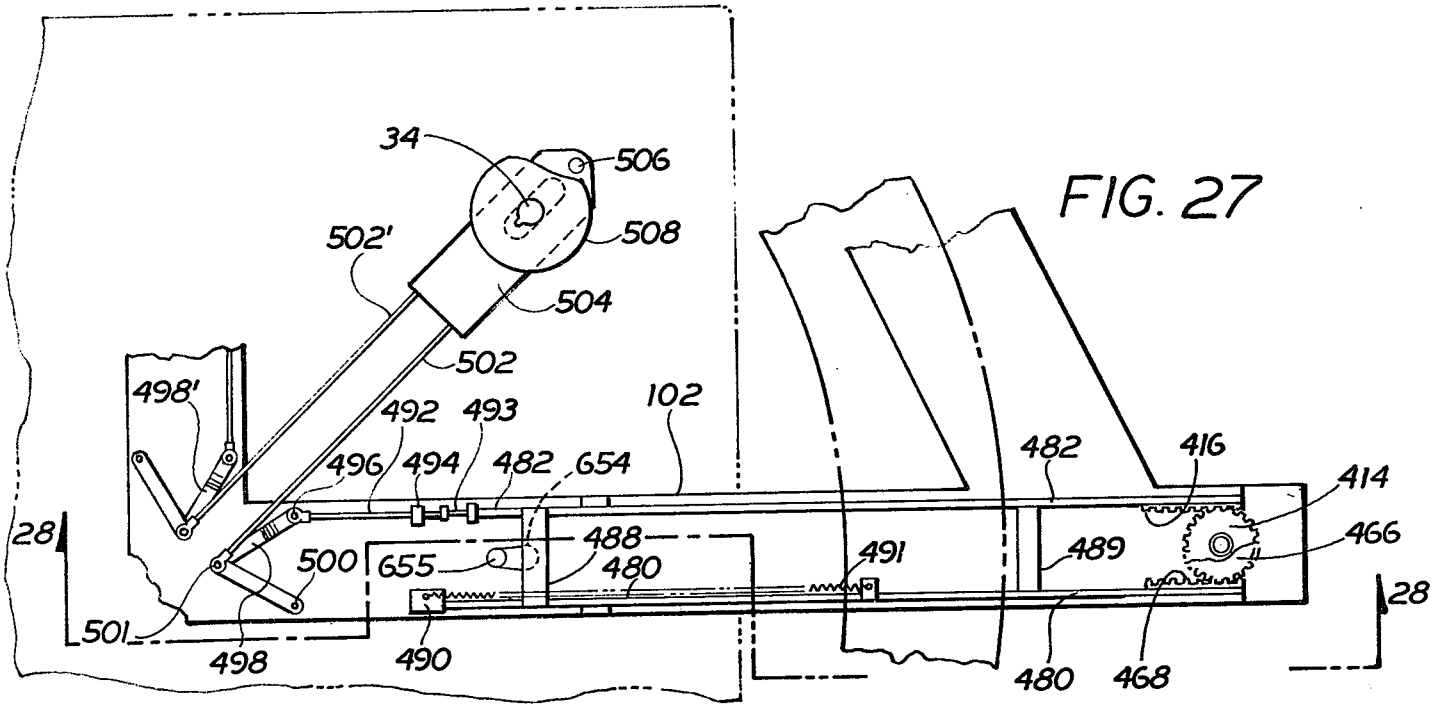
FIG. 27 is a plan view of a portion of the mechanism employed to reciprocate the roller carriers of the pumping station for boosting and purging.
Figure 28:
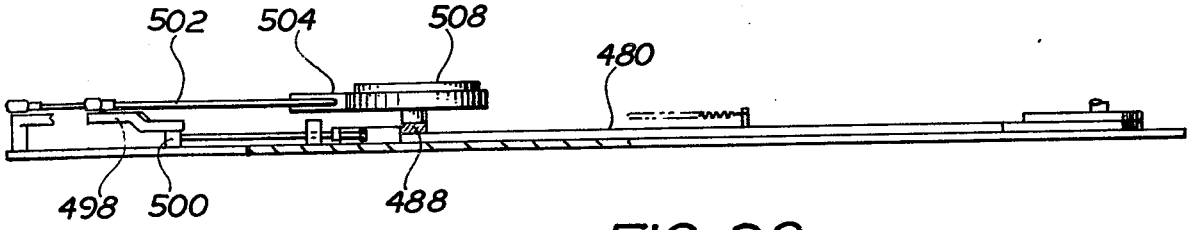
FIG. 28 is a side elevation of the mechanism of FIG. 27.

Racks 416 and 468 are respectively secured to arms 482 and 480 (FIG. 27) which are secured together by cross members 488 and 489. As shown in FIG. 27 arm 480 is biased into contact with a stop member 490 by a spring 491 and arm 482 is adapted to be contacted by a rod 492 having an adjustable threaded tappet 493 at its end guided by bearing block 494. Rod 492 is pivotally connected at 496 to a bell crank lever 498 which is pivotally mounted on a pin indicated at 500 and carries a pin 501 to which is pivotally connected a rod 502 which is connected to a slide 504 having a cam follower 506 adapted to be engaged by a cam 508 mounted on shaft 34. This mechanism serves to advance the rollers 384 a short distance (for example, 5% of the total advance) before they are advanced due to the movement of the carriage 166 in order to compensate for the opening up of the tubes 374 when valves 712, 714, 720 and 722 open to insure a flow of culture medium fluid into paddles 50 before the fluid delivery members 302 and 304 start to move along the length of their respective paddles 50 as will be detailed further in describing the operation of the device. The distance of advance is determined by the adjustment of the tappet 493 which determines how much movement of arms 480 and 482 is provided by the interaction of cam 508 and follower 506.

Figure 15:
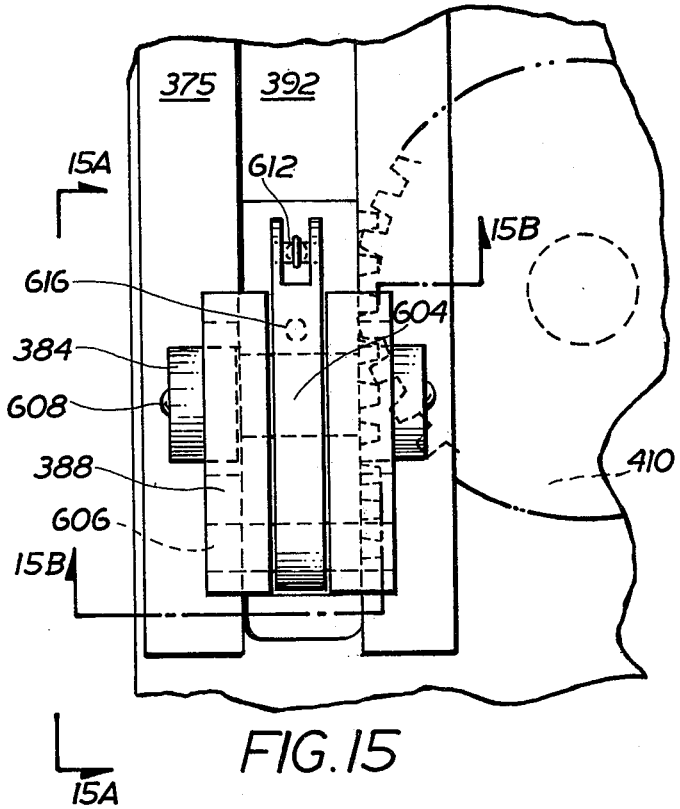
FIG. 15 is a plan view partially broken away of a pumping station roller carrier.
Figure 15A:
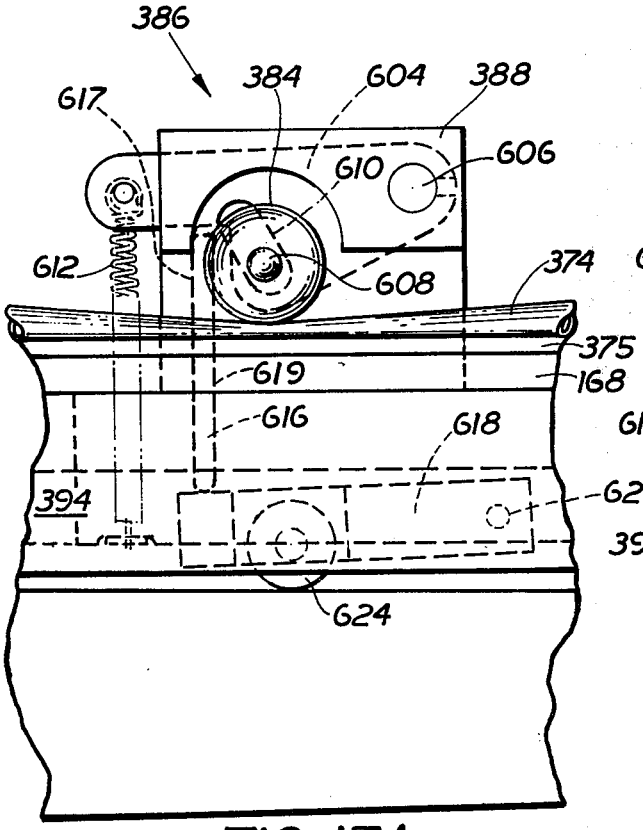
FIG. 15A is a view of the structure of FIG. 15 taken on the plane indicated by the line 15A—15A in FIG. 15.
Figure 15B:
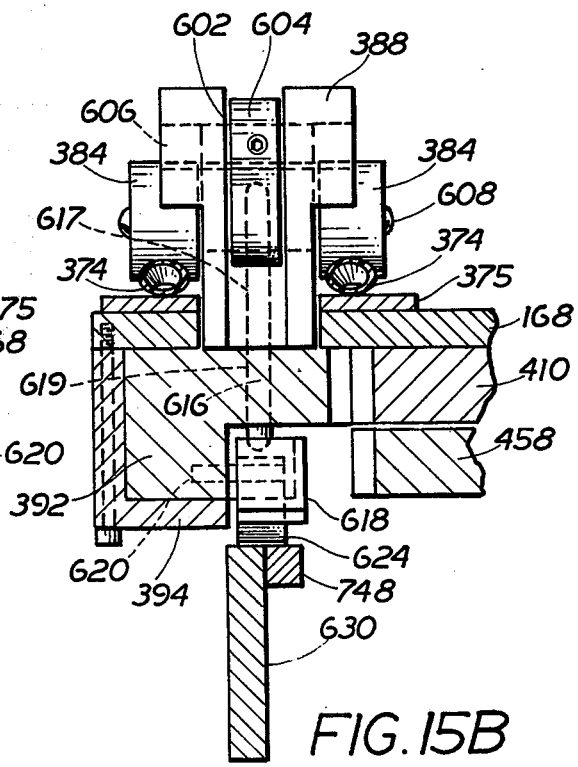
FIG. 15B is a vertical section taken on the plane indicated by the line 15B—15B in FIG. 15.

To provide for the raising and lowering of rollers 384, each block 388 has a slot 602 in which is mounted a lever 604 (FIGS. 14 and 15B) pivotally secured to a pin 606 (FIGS. 14 and 15A). Each roller 384 is mounted for rotation on a pin 608 fixedly secured to lever 604 and accommodated in a slot 610 in block 388 (FIG.

15A). An extension coil spring 612 connected to each lever 604 biases it downwardly urging each roller 384 into tight contact with the adjacent resilient tube 374 so as to block the flow of liquid through the tube below the roller. Each lever 604 is engaged by a push rod 616 in opening 617 in carrier 386 and opening 619 in rack block 392 or 452 as the case may be. Rod 616 rests on a lever 618 pivoted at 620 to the adjacent rack block 392 or 452 as the case may be (FIG. 14). Lever 618 carries a roller 624 which is adapted to engage the top of lifting frame 630 (FIGS. 14 and 14A).

Figures 29, 30, 31:
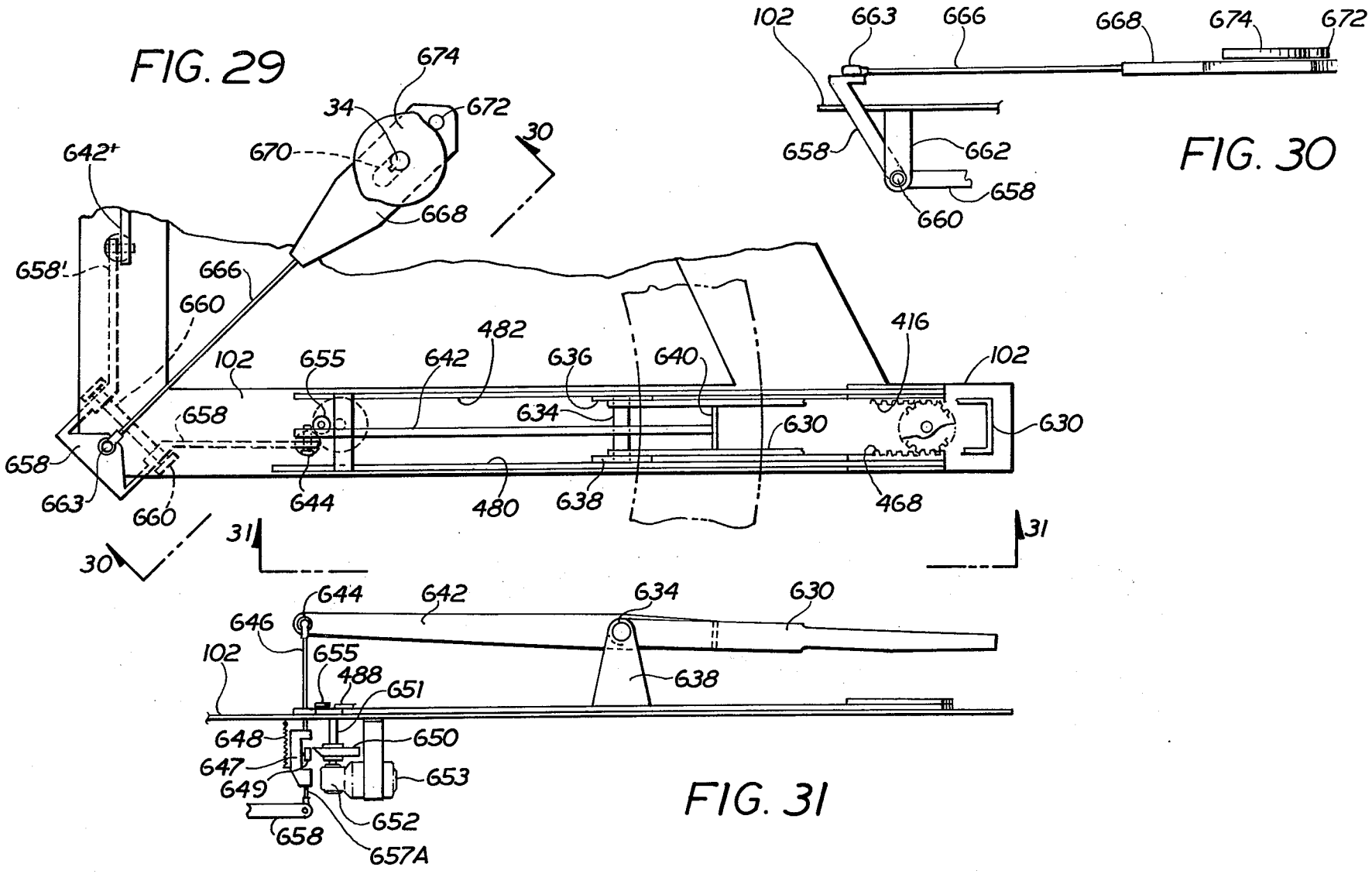
FIG. 29 is a plan view of a portion of the mechanism of the machine of FIG. 3 employed to provide movement in a vertical direction for elements of the pumping station.
FIG. 30 is a side elevation, partially broken away, of the mechanism of FIG. 29 taken on the plane indicated by the line 30—30 in FIG. 29.
FIG. 31 is a side elevation, partially broken away, showing a portion of the mechanism of FIG. 29 taken on the plane indicated by the line 31—31 in FIG. 29.
Figure 31A:
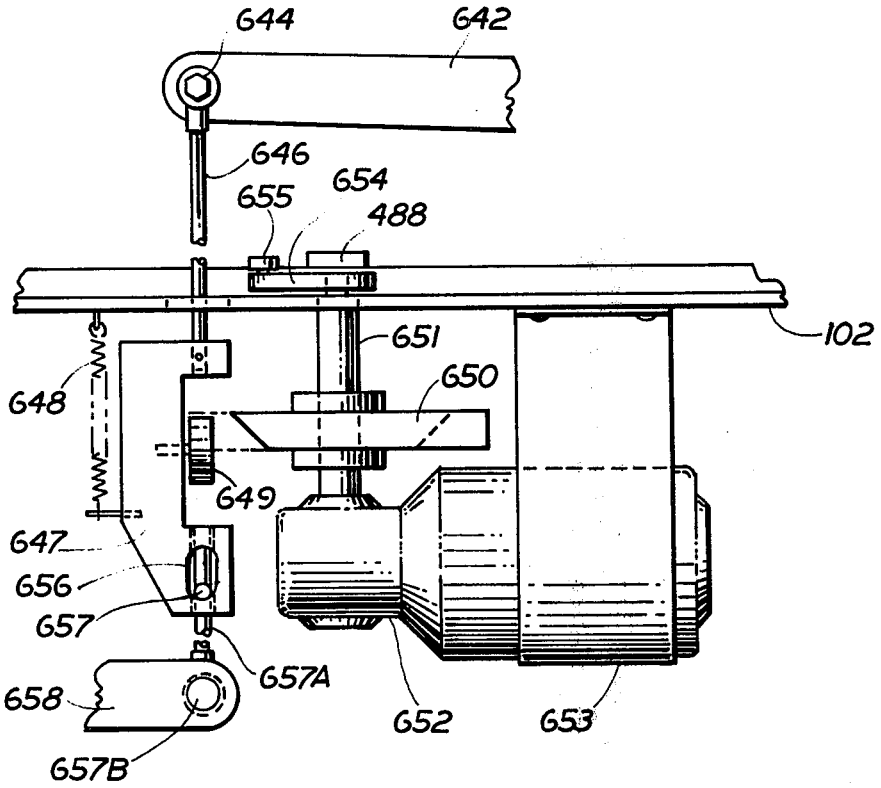
FIG. 31A is an enlarged view of a portion of the mechanism of FIG. 31 including purging mechansim.

As best seen in FIGS. 29 and 31 lifting frame 630 is secured to a pin 634 rotatably mounted in standards 636 and 638. Frame 630 has a cross brace 640 to which is secured a lever 642 secured to pin 34 and which is connected by a ball joint indicated at 644 to a rod 646. Rod 646 is secured to a "C" shaped member 647 spring biased upwardly by an extension spring 648 (FIG. 31A).

A roller 649 secured to member 647 is adpated to be engaged by a cam 650 on shaft 651 driven by speed reducer 652 driven by electric motor 653 to independently move member 647 downwardy to raise lifting frame 630 for purging the machine as detailed later. Shaft 651 for the purging operation also is connected to crank 654 (FIG. 31A) which carries a roller 655 adapted to engage cross member 488 to advance racks 416 and 468. Member 647 has a slot 656 engaged by a pin 657 on a rod 657A pivotally connected at 657B to a lever 658. Lever 658 is pivotally connected to pin 660 (FIG. 30) to a bracket 662 secured to frame 102 and again is universally secured by a ball joint at 663 to a rod 666 which is secured to a slider 668 having a slot 670 to permit the free passage of shaft 34 and a cam follower 672 to follow a cam 674 secured to shaft 34 (FIG. 29). Frame 630 remains in the downwardly tilted position shown in FIG. 31 except to the extent it is moved out of this position by the operation of cam 674 which on urging slider 668 in a direction away from bracket 662 causes lever 642 to move in a direction counterclockwise on the axis of pin 634 as viewed in FIG. 31 to rotate frame 630 upwardly as viewed in FIG. 31. This causes the elevation of each roller 624 (FIG. 14) and the consequent movement of each lever 618 and push rod 616 to pivot levers 604 to lift each roller 384 above its corresponding resilient tube 374.

Figure 32:
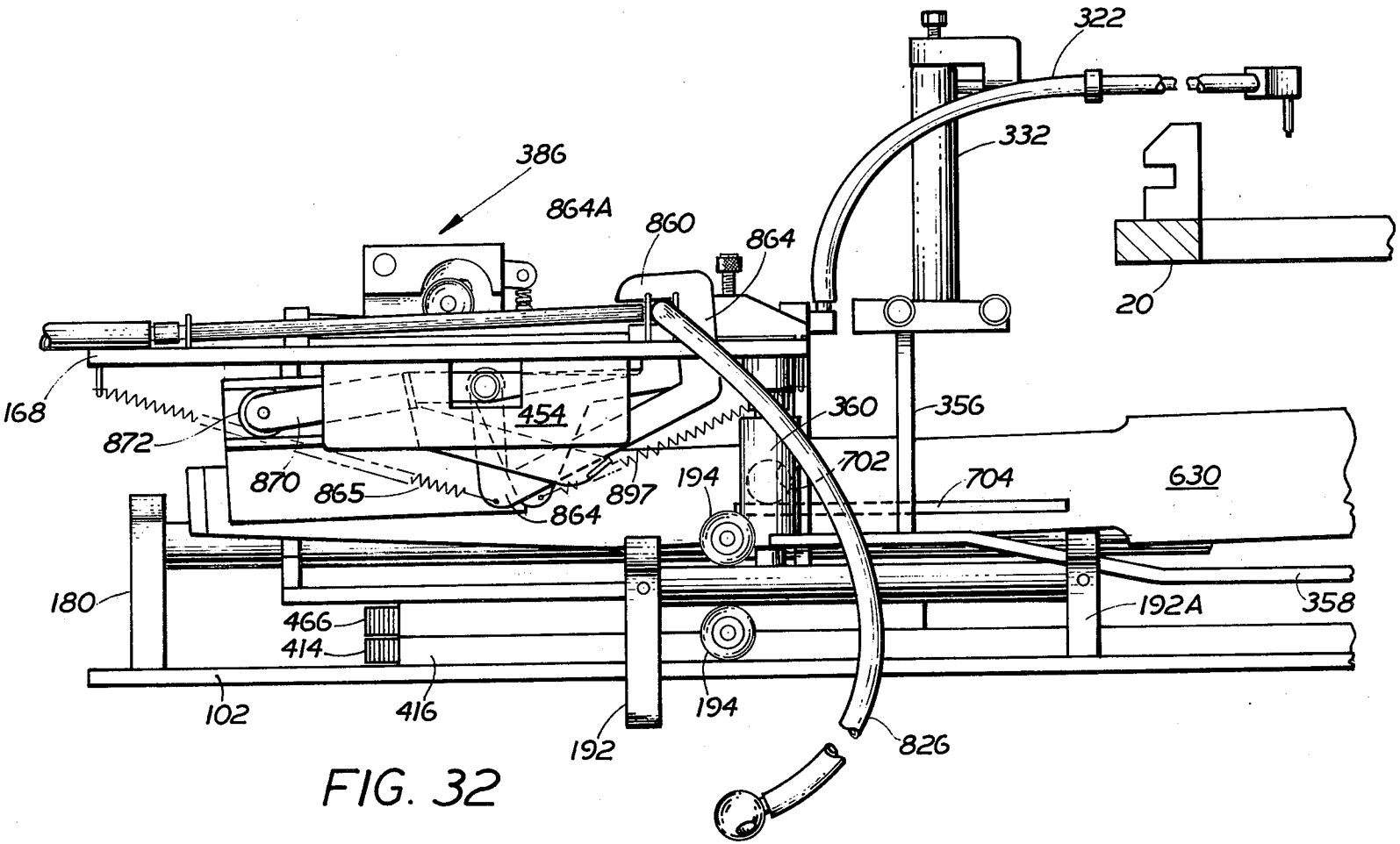
FIG. 32 is a right side elevation of the pumping station of the machine of FIG. 3.

The elevation of frame 630 also effects the lifting of fluid discharge members 302 and 304. In each case, this is accomplished by virtue of a roller 702 (FIG. 13 ) which is secured to the respective member 360 and is adapted to be engaged by a flange 704 which is secured to member 630 as best seen in FIGS. 13 and 32.

Figure 24:
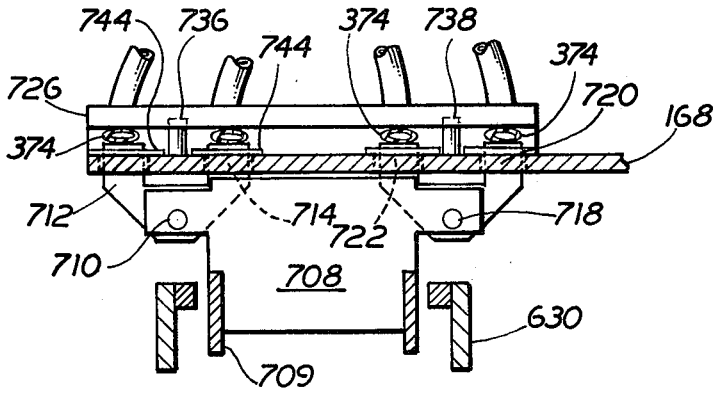
FIG. 24 is a vertical section taken on the plane indicated by the line 24—24 in FIG. 12.
Figure 25:
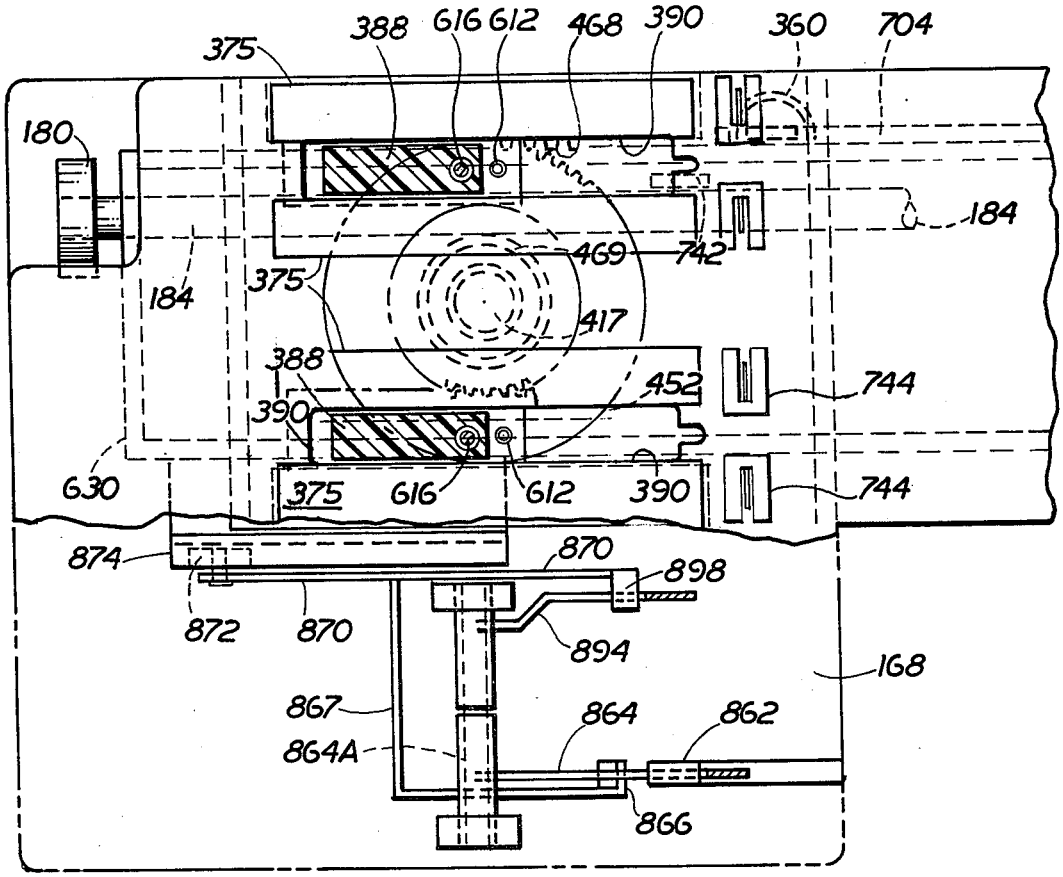
FIG. 25 is a horizontal section taken on the plane indicated by the line 25—25 in FIG. 23C.

Lifting frame 630 also controls a variety of values. A plate 708 secured to frame 709 (FIGS. 14A and 24 and 26) has pivotally secured thereto at 710 a pair of fingers 712 and 714 (FIG. 24) which pass through an opening in plate 168 and are adapted to engage a pair of tubes 374 immediately thereabove. Similarly, there is secured pivotally as indicated at 718 a pair of fingers 720 and 722 which pass upwardy freely through plate 168 and again engage a pair of adjacent tubes 374. Immediately above the tubes 374 and these fingers is a backup plate 726 (FIGS. 12 and 24) secured to yoke 728 which pivots on pin 730 in post 732 mounted on carriage plate 168. Backup plate 726 rests on standards 736 and 738 (FIG. 24). A headed screw 740 (FIG. 12) threaded to plate 168 holds plate 726 in the operating position and is removed to permit plate 726 to swing up to facilitate the installation of tubes 374. Plate 726 squeezes each tube 374 down against a "U" shaped member 744 (FIGS. 24, 25 and 26) to keep the tube opening in this area small so that when the respective finger moves away from the tube, the volume change within the tube will be kept at a minimum so that the tube will not suck liquid back away from the nozzles.

Figure 26:
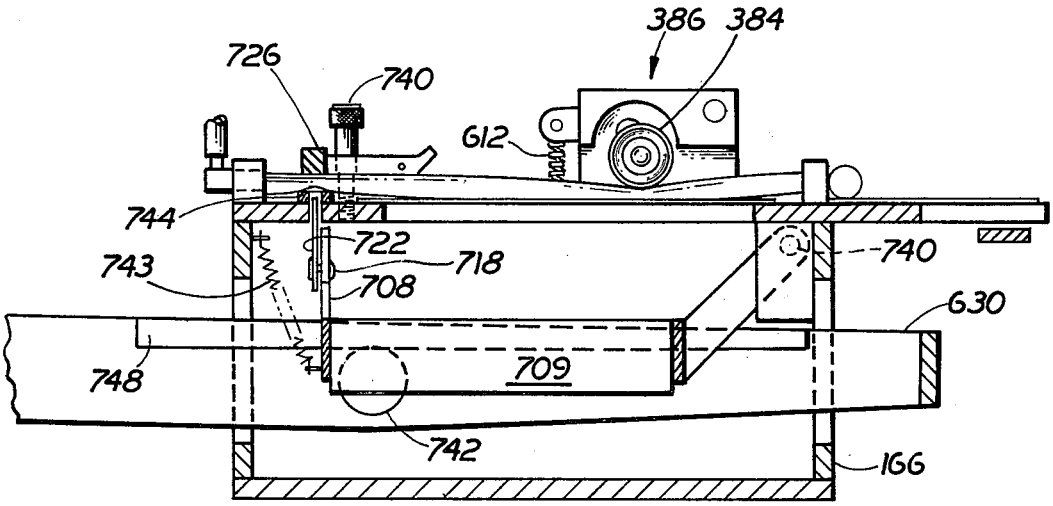
FIG. 26 is a vertical section through the pumping station carriage taken on the plane indicated by the line 26—26 in FIG. 12 to show a pumping station valve operating mechanism.

Frame 709 is pivotally secured to carriage 166 as indicated at 740 (FIG. 26) and carries a pair of rollers 742, 742 (FIGS. 23C and 26) each of which lies underneath a strip 748 on frame 630. Frame 709 is biased upwardly by an extension spring 743 (FIG. 26).

This structure constitutes a valve for each resilient tube 374 to control the flow therethrough downstream of the rollers 384 with the tubes 374 being shut off when the lifting frame 630 is in the elevated position. During a feeding stroke, rollers 384 engage tubes 374 before fingers 712, 714, 720 and 722 release tubes 374 and, during a return stroke, these fingers close off tubes 374 before rollers 384 release these tubes.

Figure 12:
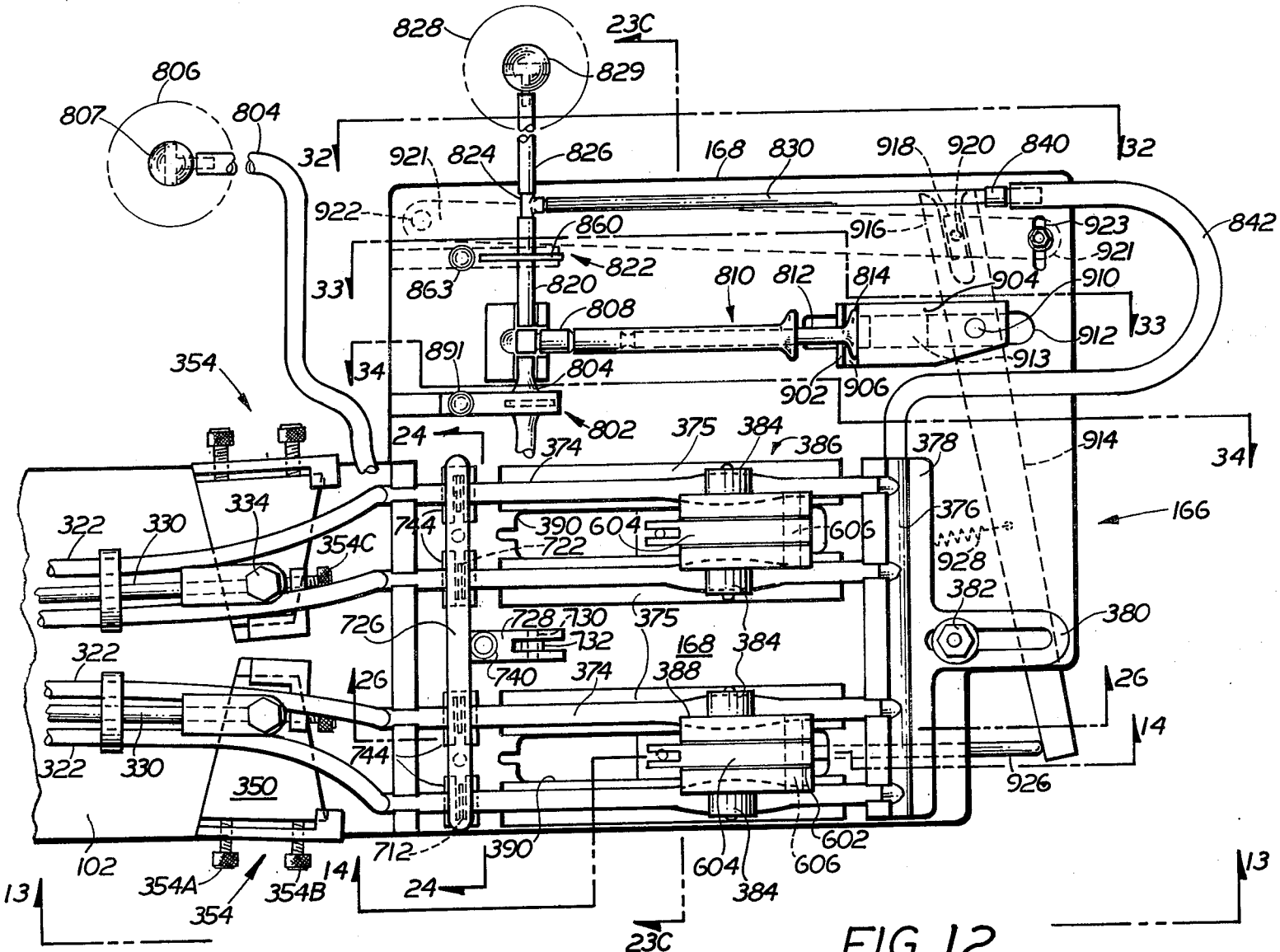
FIG. 12 is a plan view of the first pumping station of the machine of FIG. 3.
Figure 33:
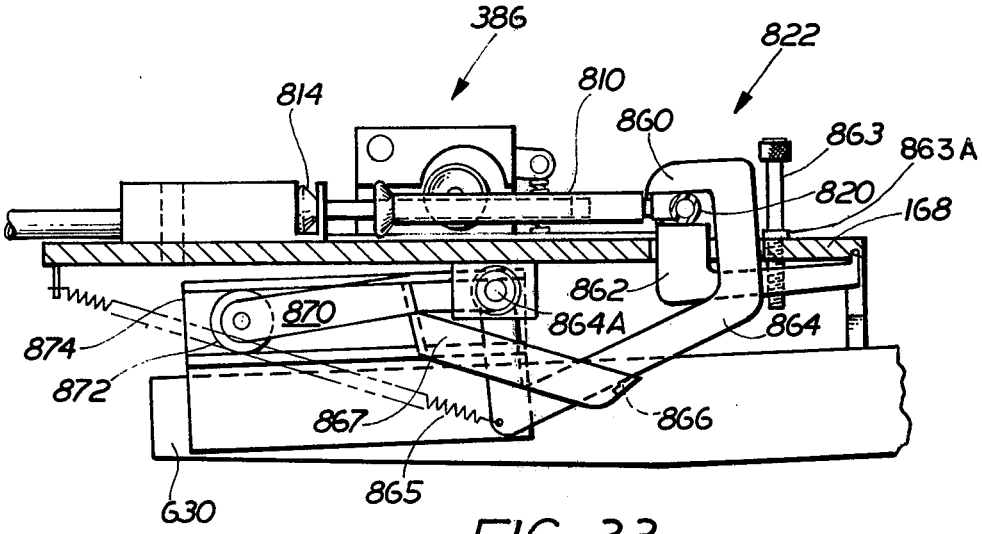
FIG. 33 is a vertical section through the pumping station taken on the plane indicated by the line 33—33 in FIG. 12 showing valve mechanism.

Additional valves are also operated by the movement of the frame 630. As seen in FIG. 12, a pinch valve 802 (also FIG. 34) is associated with a resilient tube 804 which is connected to a container 806 containing blood at room temperature (FIG. 3). As seen in FIG. 12 tube 804 at its lower end is attached to a ported fitting 807 which is received inside container 806 (FIG. 3). Tube 804 is also connected to a T-fitting 808 (FIG. 12) to which is secured a syringe 810 which has a plunger 812 having a head 814. T-fitting 808 is also connected to a resilient tube 820 which is controlled by a pinch valve shown at 822 (FIGS. 12 and 33). Tube 820 is connected to a T-fitting 824 which in turn is connected to a resilient tube 826 in communication with a controlled temperature (heated) container 828 (FIG. 3) which contains a liquid culture medium at an elevated temperature at which blood deteriorates. As shown in FIG. 12 tube 826 at its lower end is connected to a ported fitting 829 which is received in container 828. Fitting 824 (FIG. 12) is also connected to a mixing tube 830 which in turn is connected to a fitting 840. Advantageously, mixing tube 830 is any of the well known mixing tubes providing a circuitous flow path such as the type employing a pair of opposite hand helical blades which is well known to the art and generally referred to as a static mixer. A flexible tube 842 connects fitting 840 with manifold 376.

Pinch valve 822 as seen in FIG. 33 has a horizontal finger 860 above a pivoted backup member 862 secured by a screw 863 having a shoulder 863A bearing on plate 168 and the portion of screw 863 below shoulder 863A passing freely through plate 168 and threaded to member 862 to permit the lowering of member 862 for hose insertion. Flexible tube 820 runs between finger 860 and member 862. Finger 860 is integral with a lever 864 which is pivoted around rod 864A and is urged by spring 865 to pinch hose 820 closed. A hook 866 secured to lever 867 is adapted to engage lever 864 to move finger 860 up away from tube 820. Lever 867 is secured to lever 870 which is pivoted around rod 864A and carries a roller 872 confined in roller track 874. Roller track 874 is fixedly secured to lifting frame 630 so that the upward movement of frame 630 causes the rotation of levers 870 and 867 to withdraw hook 866 away from lever 864 and permit spring 865 to close pinch valve 822 and block flow through tube 820.

Figure 34:
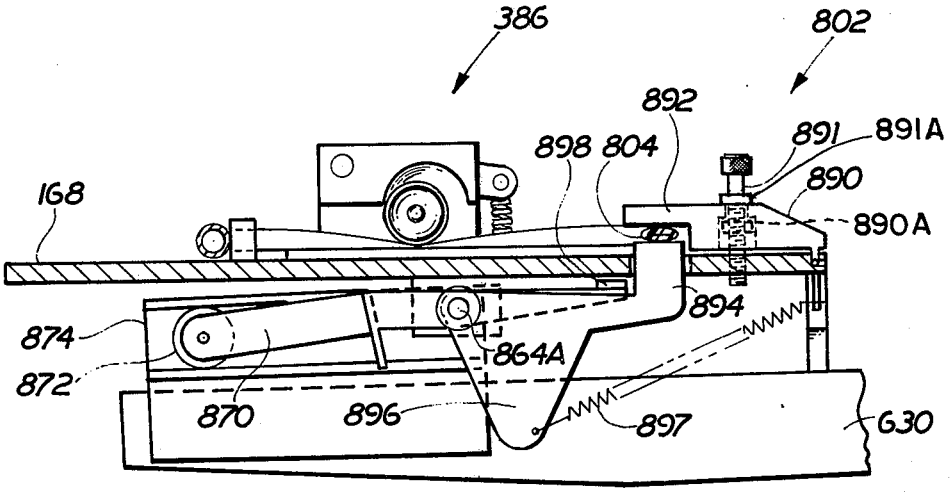
FIG. 34 is a vertical section taken on the plane indicated by the line 34—34 in FIG. 12 showing valve mechanism.

Referring to FIG. 34 valve 802 has a pivotal block 890 enclosing a collar 890A affixed to a screw 891 having a shoulder 891A bearing on the top of block 890. Screw 891 is threaded into plate 168 to provide for the raising of block 890 for insertion of hose 804 under finger 892. Underlying flexible tube 804 is a finger 894 which passes freely through plate 168 and is integral with a lever 896 which is pivoted around rod 864A and biased in the valve closed position by a spring 897. A hook 898 adapted to engage lever 896 is integral with lever 870 and spaced from lever 896. When lifting frame 630 raises and after valve 822 is closed, the further pivoting of lever 870 causes hook 898 to move into contact with lever 896 and moves finger 894 to open valve 802. Hook 898 is spaced from lever 896 to cause a short delay in the opening of valve 802. It will be apparent that valve 822 will be closed when valve 802 is opened and vice versa.

Referring back to FIG. 12, plunger 812 of syringe 810 passes through a slot 902 in a block 904 which has a transverse downwardly extending recess 906 for the retention of plunger head 814 so that the plunger will move with block 904. Block 904 is pivotally connected to a pin 910 which passes through a slot 912 in plate 168 and is secured to a lever 914. Block 904 has a guiding tongue 913 which rides in slot 912. Lever 914 has a fork end 916 which slidably engages a block 918 which is pivotally secured at 920 to lever 921 which is pivotally secured to plate 168 and 922 at one end and at the other end carries a head screw which passes through slot 923 in plate 168 and engages plate 168 to lock lever 921 in the position which will provide block 904 with the desired movement responsive to movement of push pin 926 by rack block to which it is secured (FIG. 14) and hence produce the desired pumping action of syringe 810. Lever 914 is biased against push pin 926 by an extension coil spring 928.

PADDLE TURN OVER MECHANISM

Figure 35:
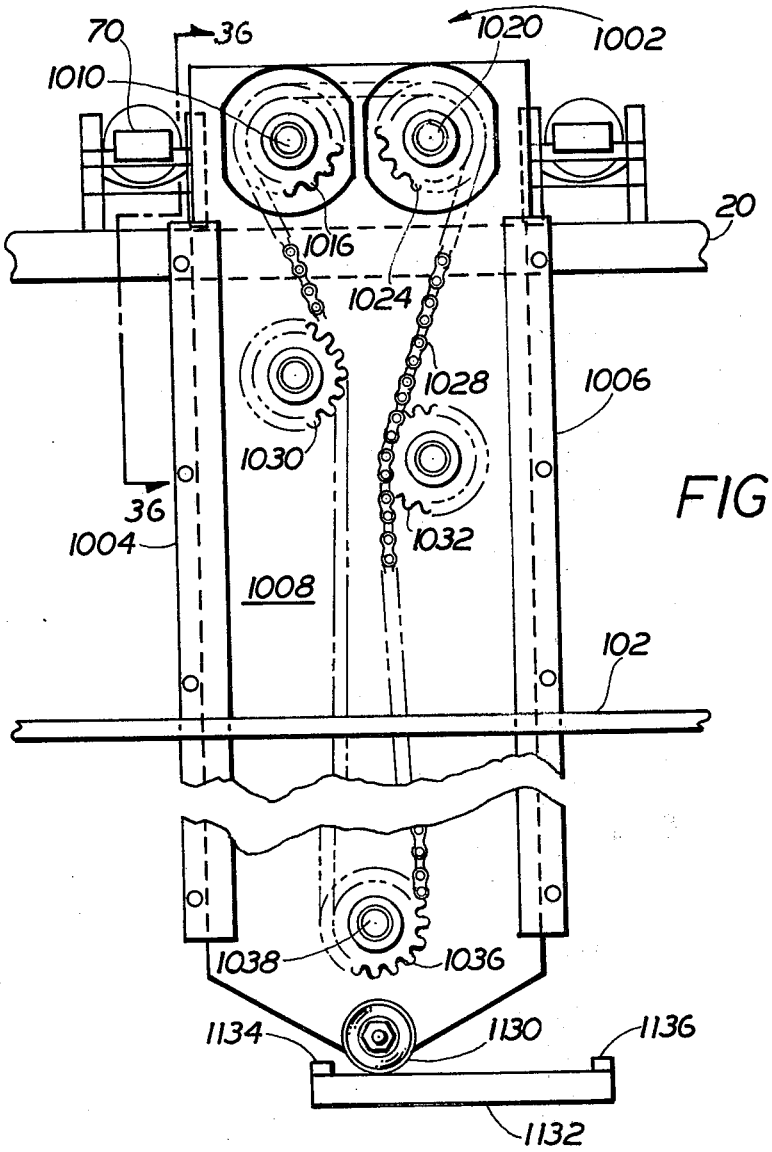
FIG. 35 is a front elevation of the turn over mechanism of the machine of FIG. 3.
Figure 36:
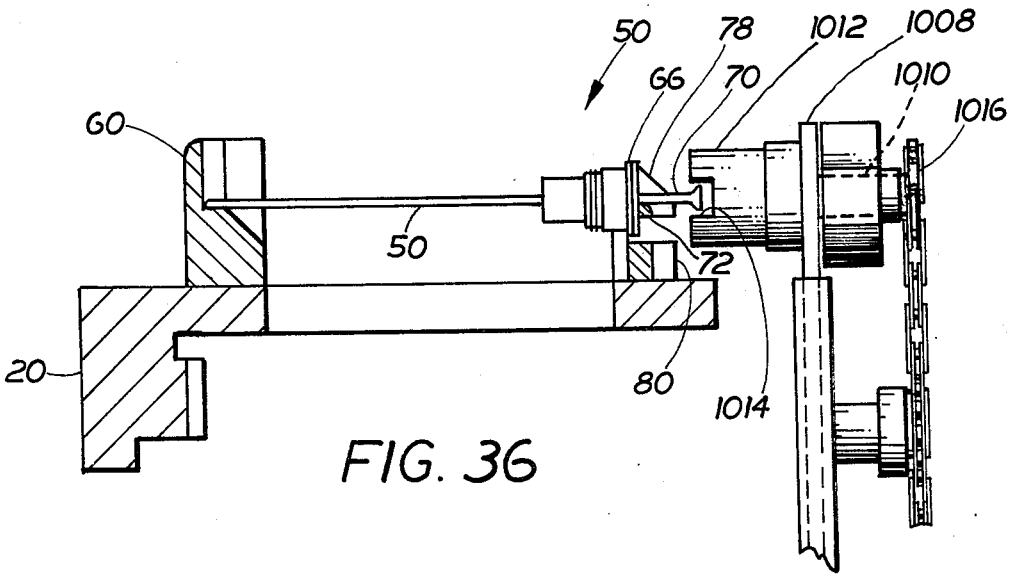
FIG. 36 is a section taken on the plane indicated by the line 36—36 in FIG. 35 and partially broken away.

A paddle turn over mechanism 1002 (FIG. 3) has as best seen in FIG. 35 a pair of slotted guide members 1004 and 1006 which are fixedly secured to oscillating frame 102. A slide 1008 is mounted for vertical sliding in members 1004 and 1006. Slide 1008 has rotatably mounted therein a shaft pin 1010 which has fixedly secured thereto a turning member 1012 (FIG. 36) which has a slot 1014 for the reception of handle 70 of a paddle 50. Shaft 1010 is fixedly secured to a sprocket 1016. Similarly, a shaft 1020 is mounted for rotation in slide 1008 and has fixedly secured thereto a turning member 1012, which is spaced from the first-mentioned turning member 1012 a distance equal to the distance between the centers of the paddle handles on ring 20. Shaft 1020 is fixedly secured to a sprocket 1024. Sprockets 1016 and 1024 are driven by an endless chain 1028 which passes over idler pulleys 1030 and 1032. Chain 1028 is driven by sprocket 1036 secured to shaft 1038.

Figures 37, 38, 39:
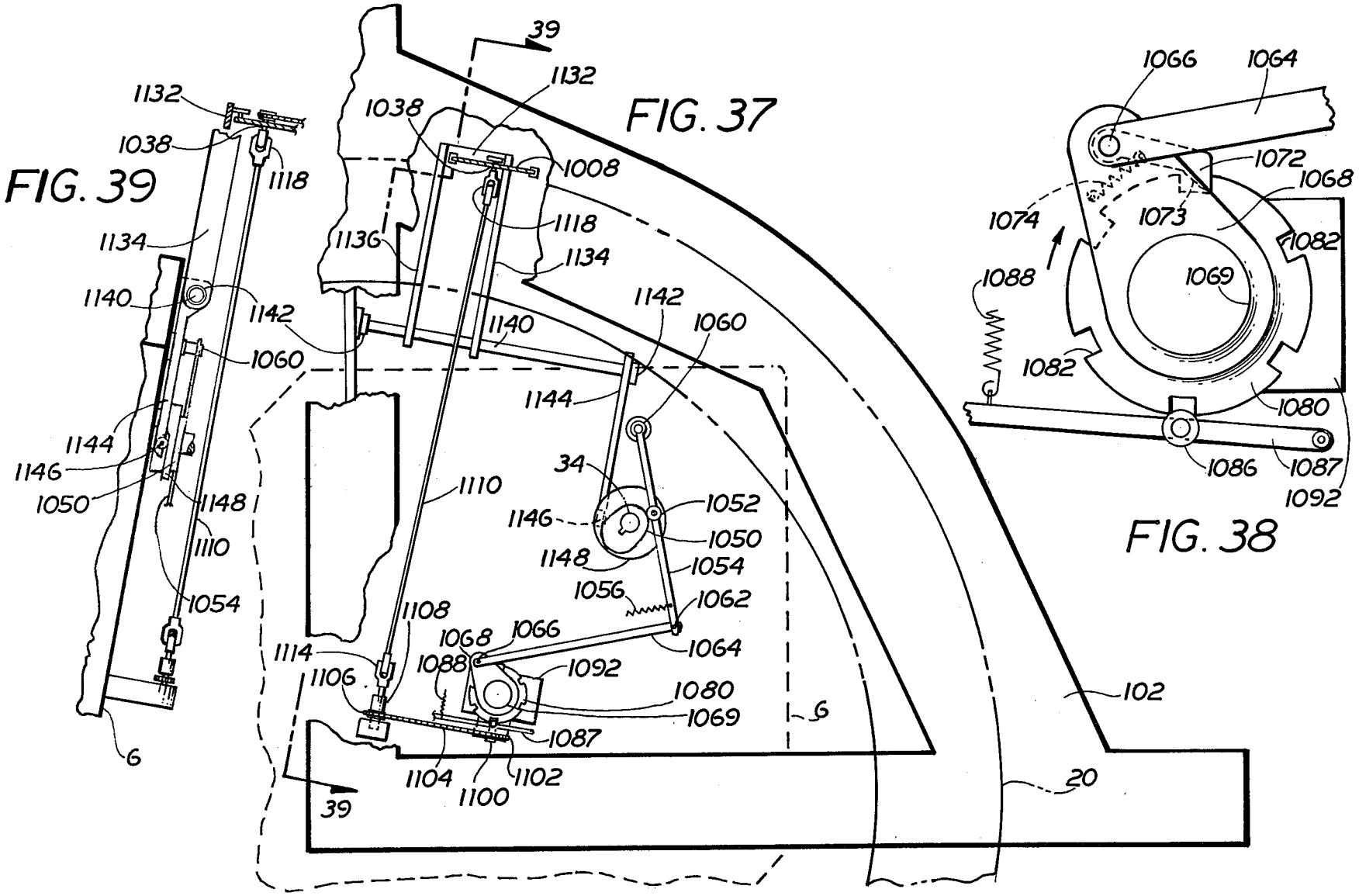
FIG. 37 is a plan view showing operating mechanism for the turn over mechanism.
FIG. 38 is a plan view of the ratchet section of the turn over mechanism.
FIG. 39 is an elevational view of a portion of the turn over mechanism of FIG. 37.

Turn over members 1012 are rotated 180° periodically by virtue of the action of a cam 1050 connected to shaft 34 (FIG. 37). Cam 1050 is engaged by a cam follower 1052 on a lever 1054 which is biased by a spring 1056 which urges cam follower 1052 into engagement with cam 1050. Lever 1054 is pivotally mounted as indicated at 1060 and is pivotally connected at 1062 to a lever 1064 which is pivotally connected at 1066 to a ratchet lever 1068 pivoted at 1069. As best seen in FIG. 38 ratchet lever 1068 has a pawl 1072 with a sloping face 1073 pivotally connected to the lever 1068. Pawl 1072 is urged by a spring 1074 secured to lever 1068 into engagement with a ratchet wheel 1080 which has fixed equally spaced recesses 1082 which are adapted to be engaged by pawl 1072. A detent roller 1086 is adapted to engage a recess 1082 in wheel 1080 to arrest wheel 1080 when it is not being moved by pawl 1072. Detent roller 1086 is mounted on a pivoted lever 1087 biased towards ratchet wheel 1080 by a spring 1088. Wheel 1080 drives bevel gear right angle drive 1092 which drives a shaft 1100 which carries a sprocket 1102 which drives a chain 1104 which in turn drives a sprocket 1106 fixedly secured to a stub shaft 1108. Stub shaft 1108 is connected to shaft 1110 by a universal joint indicated at 1114. Shaft 1110 is connected by a universal joint indicated at 1118 to shaft 1038 (FIG. 39).

Figure 10:
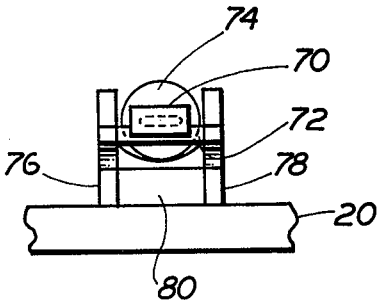
FIG. 10 is a view partially broken away taken on the plane indicated by the line 10—10 in FIG. 8.

For the raising and lowering of slide 1008, slide 1008 carries a roller 1130 (FIG. 35) which rides on a plate 1132 carried by levers 1134 and 1136 which are fixedly secured to a shaft 1140 mounted for rotation on its axis in bearings 1142 and fixedly connected to a lever 1144 which has a cam follower roller 1146. Roller 1146 rides on the bottom surface of cam 1148 which is fixedly secured to shaft 34. This mechanism acts to raise slide 1008 to clear the paddles engaged by turning members 1012, 1012 from bar 72 (FIG. 10) during the rotation of the paddle. Plate 1132 is of a sufficient width to accommodate the relative moement in a horizontal plane between the slide 1008 and plate 1132. The weight of slide 1008 causes roller 1130 to bias the plate 1132 downwardly.

DESCRIPTION OF WIRING DIAGRAM

Figure 40:
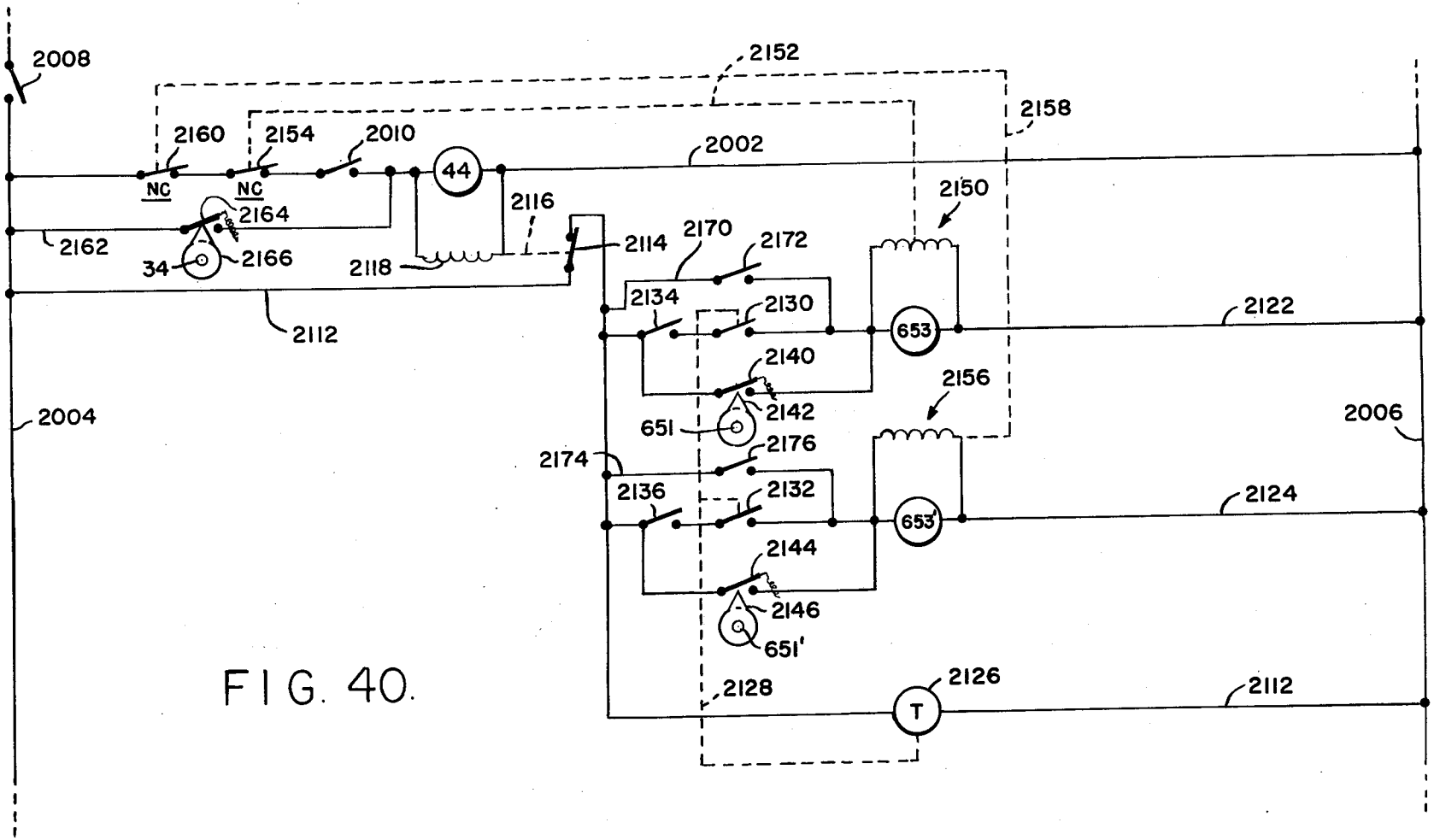
FIG. 40 is a schematic wiring diagram.

Referring to FIG. 40, a line 2002 is connected to lines 2004 and 2006 of a 115 volt power system. Line 2004 has a main switch 2008. Line 2002 contains a manual switch 2010 and motor 44.

A line 2112 is connected to line 2004 and line 2006 and contains a switch 2114 controlled by arm 2116 of a relay 2118 which is connected to line 2002 in parallel with motor 44. Switch 2114 is normally closed and is opened when relay 2118 is energized.

Purge motor 653 is in line 2122 which is connected to lines 2006 and 2112. Similarly, purge motor 653′ is in line 2124 connected to lines 2006 and 2112. An electromechanical timer 2126 is in line 2112 and has a mechanical connection indicated at 2128 to control switch 2130 in line 2122 and switch 2132 in line 2124. Line 2122 has a manual switch 2134 in series with switch 2130 and line 2124 has a manual switch 2136 in series with switch 2132. A switch 2140 which is spring biased to the closed position is connected to line 2122 in parallel with switches 2134 and 2130. Switch 2140 is adapted to be opened by a cam 2142 secured to shaft 651 which is driven by motor 653 when shaft 651 is at the end of a cycle. Similarly, a switch 2144 which is spring biased to the closed position is connected to line 2124 in parallel with switches 2136 and 2132. A cam 2146 connected to shaft 651′ is adapted to open switch 2144 when shaft 651′ is at the end of a cycle.

A relay 2150 connected to line 2122 in parallel with motor 653 has a mechanical connection indicated at 2152 to switch 2154 in line 2002. Similarly, a relay 2156 connected to line 2124 in parallel with motor 653′ has the mechanical connection indicated at 2158 to a switch 2160 in line 2002. When relays 2150 and 2156 are energized the normally closed switches 2154 and 2160, respectively, are opened. In order to provide that the machine 2 will come back to the beginning of a cycle position when motor 44 is shut down, a line 2162 is connected to line 2004 and to line 2002 between switch 2010 and motor 44. Line 2162 contains a switch 2164 which is spring biased in the closed position and can be opened by cam 2166 secured to shaft 34 in a position to open switch 2164 when the machine 2 is at the end of a cycle (in the neutral position).

A line 2170 with a manual switch 2172 is connected to line 2112 and to line 2122 between switch 2130 and motor 653 to permit continuous operation of motor 653 when desired. Similarly, a line 2174 with a manual switch 2176 is connected to line 2112 and to line 2124 between switch 2132 and motor 653' to permit continuous operation of motor 653'.

In the preparation for operation of machine 2, motors 653 and 653' are operated continuously by closing switches 2008, 2172 and 2176 to warm up the lines conducting the culture medium fluid. Switches 2172 and 2176 are then opened. Switch 2134 is then manually closed causing current to be supplied to motor 653 through line 2122 when the switch 2130 is in the closed position incident to the operation of timer mechanism 2126. This energizes relay 2150 which opens switch 2154 preventing the operation of motor 44. Switch 2136 is then manually closed causing a current to flow to motor 653' through line 2124 when switch 2132 is in the closed position incident to the operation of timer 2126. This energizes relay 2156 which opens switch 2160 to prevent motor 44 from operating. A typical cycle for the timer mechanism 2126 is to have switches 2130 and 2132 closed for about 12 seconds and opened for about 20 seconds. After the fluid conducting lines are warmed up, this keeps the culture medium from hardening in the lines and yet prevents wastage by not having the purging operation continuous.

Now when it is desired to commence the operation of motor 44 to put the machine 2 in its normal operating condition, switch 2010 is closed and when both switches 2130 and 2140 are in the open position incident to the operation of timing mechanism 2126 and cam 2142, motor 653 will be deenergized with shaft 651 at the end of a cycle or zero position and relay 2150 will be deenergized causing switch 2154 to close. Assuming that motor 653' was also operating in the same fashion switches 2132 and 2144 will both be opened which will stop the operation of motor 653' with shaft 651' in the zero position or end of cycle position. Relay 2156 will be deenergized causing switch 2160 to close which will now energize line 2002 and permit motor 44 to operate. Simultaneously, relay 2118 is energized opening switch 2114 which prevents further operation of motors 653 and 653'.

The shafts 651 and 651' each go through a full turn in, for example, 4 seconds. Since the switches 2130 and 2132 remain open for about 20 seconds it is clear that switches 2130 and 2140 will both be open shortly after switch 2010 is closed as is the case with switches 2132 and 2144.

When it is desired to temporarily stop the operation of motor 44, switch 2010 is opened and motor 44 will continue to drive until the shaft 34 is in its zero or starting position at which time switch 2164 will be opened by cam 2166 causing the motor 44 to stop operating and also causing the deenergizing of relay 2118 and the closing of switch 2114 which then again permits the motors 653 and 653' to operate intermittently as described above to keep the culture medium from hardening in the lines.

OPERATION

In the embodiment described above it is desired to fill the paddles 50 with a mixture of blood which is stored in container 806 at room temperature and a culture medium which is stored in container 828 which is maintained at an elevated temperature. Typically, the culture medium will be maintained at a temperature of 55°C.

The blood and the culture medium are mixed just prior to use, since blood will deteriorate if it is stored at the temperature at which it is desired to maintain the culture medium. The first step is to place the blood in container 806 and the culture medium in container 828 for pumping station 160. Only the operation with respect to pumping station 160 will be described, since the operation of pumping station 162 is identical.

Figure 1:
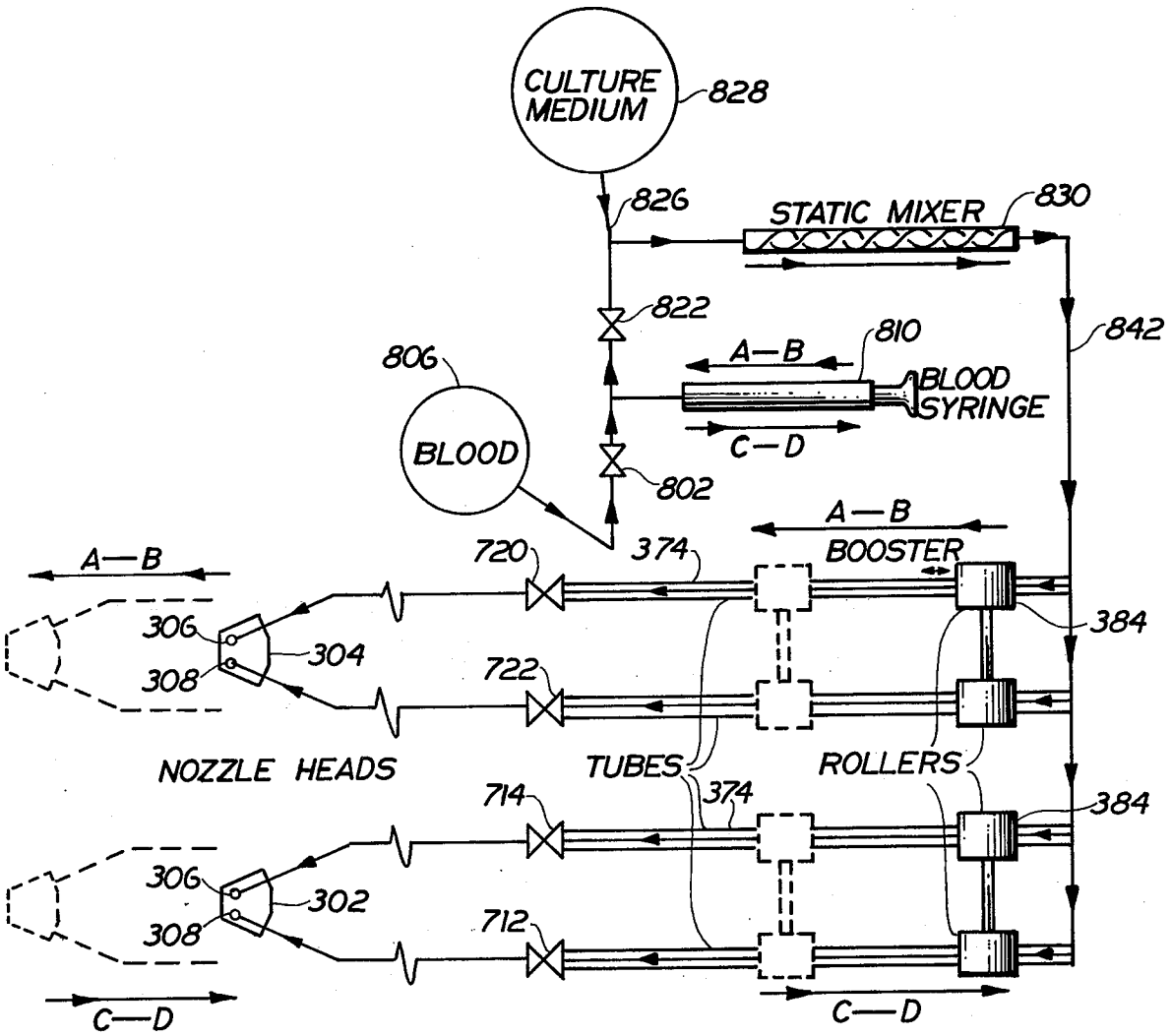
FIG. 1 is a fluid flow schematic of the operation of the machine of the invention.
Figure 2:
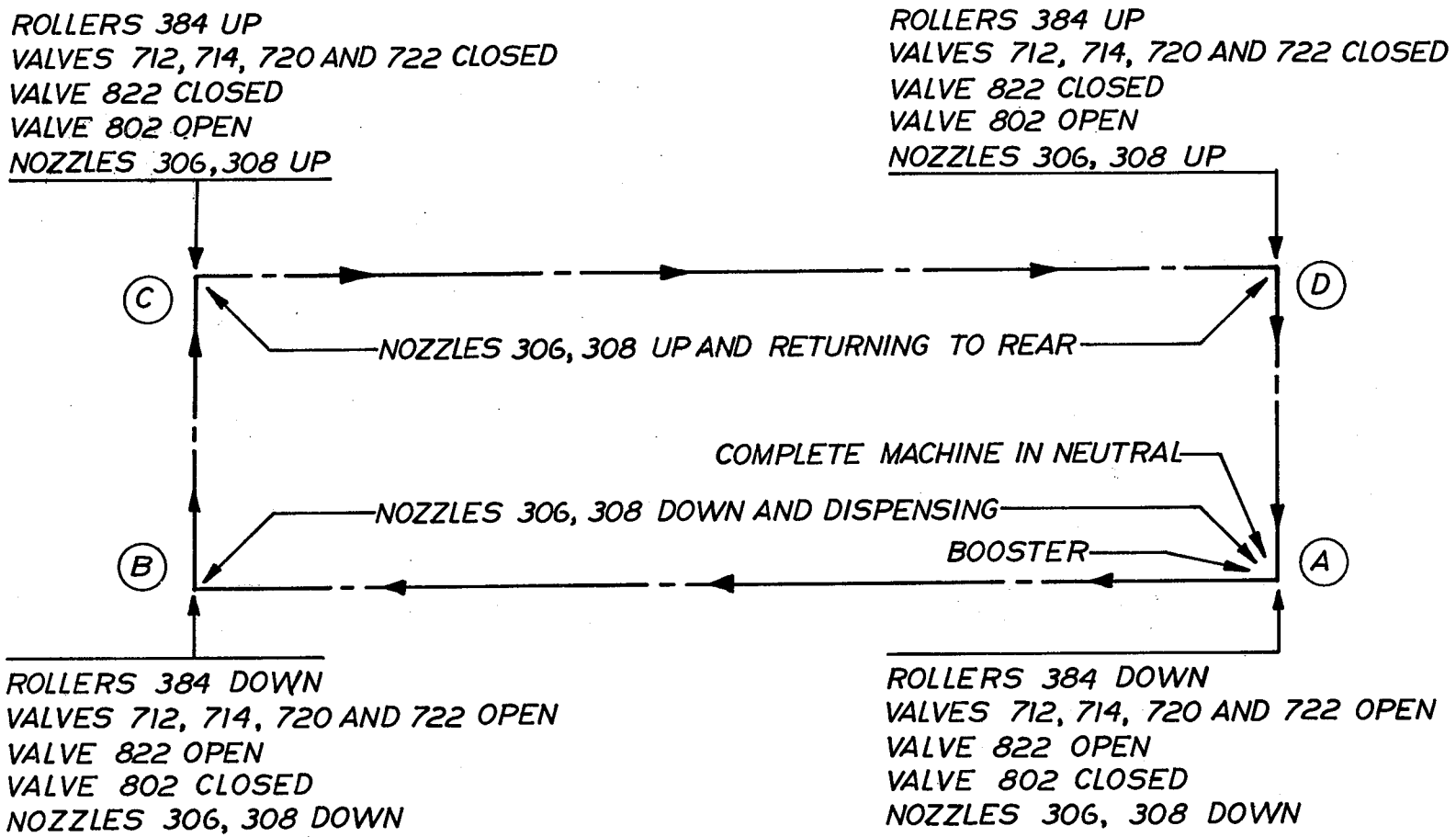
FIG. 2 is a schematic of the main pumping operation of the machine of the invention.

In connection with the description of the operation of the machine attention is directed to FIG. 1 which illustrates schematically the flow of fluid from the supply to the dispensing heads and to FIG. 2 which illustrates schematically the four stages, designated A, B, C and D, of the main pumping operation. These figures provide an overall description of the fluid delivery system of the machine in accordance with the invention.

Referring now to the wiring diagram of FIG. 40, wherein the parts are shown in the shut off position of machine 2, the next step is closing main line switch 2008 and switches 2172 and 2176 to operate purge motors 653 and 653' continuously.

The actuation of purge motor 653 causes speed reducer 652 to rotate shaft 651 which rotates the crank 654 (FIG. 31A) which causes interaction between roller 655 and cross member 488 to advance arms 480 and 482 to the right (FIG. 27) and hence racks 468 and 416. Rack 416 drives gear 414 (FIGS. 14A and 23C) which in turn rotates sleeve 412 (FIG. 23C) and gear 410 which drives rack 392 to move block 388 of the left-hand reciprocating carrier 386 towards ring 20. Similarly, rack 468 drives gear 466 to rotate sleeve 460 (FIG. 23C) and gear 458 to cause rack 452 to advance the block 388 of the right-hand carrier 386 towards ring 20.

At this juncture all of the rollers 384 attached to the carriers 386 are pressed against their respective tubes 374 by the actions of springs 612 on pivoted levers 604 (FIG. 14). Each lever 604 is released into the downward position by virtue of the fact that the associated pushrods 616 are permitted to drop by pivoted levers 618 whose rollers 624 rest on lifting frame 630 which at this juncture is in its lowered position. Thus, in conjunction with the movement of carriers 386, the rollers 384 are advanced towards ring 20 to force fluid through tubes 374 into tubes 322 and out through fluid discharge members 302 and 304. A container may be placed under the ring 20 to catch the discharge.

During the advance of rollers 384, lifting frame 630 has been in its low position (fully clockwise as viewed in FIG. 31), which properly positions the necessary valves. Fingers 712, 714, 720 and 722 (FIG. 24 and FIG. 12) are lowered away from their respective tubes 374 by virtue of plate 708 (FIG. 24 and FIG. 14A) being positioned in its lower position by frame 630 since rollers 742 attached to frame 709 are held down by strips 748 on frame 630 (FIG. 14A), thus permitting fluid to flow outwardly through tubes 374.

At the same time, by virtue of the lifting frame 630 being in its low position, valve 802 is closed and valve 822 is open (FIG. 12). The positioning of valve 802 is best seen in FIG. 34 where it will be seen that hook 898 is positioned in its counterclockwise position permitting spring 897 to hold lever 896 counterclockwise so as to force finger 894 upwardly to pinch tube 804 closed against finger 892 of block 890. As best seen in FIG. 33 hook 866 is in its counterclockwise position urging lever 864 counterclockwise against the action of spring 865 and causing finger 860 to be lifted above tube 820 to permit tube 820 to lie unpinched between finger 860 and block 862 and thus to position valve 822 in the open position.

In FIG. 2, operational stage A illustrates the condition of the parts of machine 2 as described immediately above.

As the carrier 386 which is most remote from syringe 810 (FIG. 12) is advanced to the left as described above, it carries along with it follower pin 926 which permits spring 928 to pivot lever 914 which pivots along with block 918 and urges vertical pin 910 to the left as viewed in FIG. 12 in slot 912 causing block 904 to move to the left and plunger 812 of syringe 810 to move left and urge blood through fitting 824 to mix with the larger flow of culture medium flowing incident to the advance of the rollers 384 from container 828 through tube 826, fitting 824 mixing tube 830, tube 842, manifold 376 and thence into tubes 374 behind rollers 384. Since valve 802 is closed at this time, it blocks flow through tube 804 towards the blood container 806.

When the rollers 384 reach their position of maximum advance, lifting frame 630 is moved to its upper position (i.e., counterclockwise as viewed in FIG. 31) by virtue of shaft 651 causing cam 650 to move member 647 down by its engagement of roller 649 (FIG. 31A). This movement of member 647 is independent of rod 657A since slot 656 accommodates pin 657 without causing it to move when member 647 moves downwardly. The downward movement of member 647 causes frame 630 to be pivoted counterclockwise to its raised position causing the upward movement of pivoted plate 708 (FIG. 26) resulting in fingers 712, 714, 720 and 722 (FIG. 24) moving upwardly and pinching their respective tubes 374 closed. After this, each follower pin 616 (FIG. 14) moves upwardly sufficiently to engage pivoted levers 604 and lift the rollers 384 upwardly above tubes 374 against the action of the springs 612 sufficiently to prevent the rollers from causing the flow of fluid through tubes 374 towards manifold 376. At the same time, the raising of lifting frame 630 causes the opening of valve 802 and the closing of valve 822 (FIG. 12). As best seen in FIG. 34 the elevation of frame 630 causes the elevation of track 874 and the elevation of roller 872 which pivots lever 870 clockwise so as to cause hook 898 to engage lever 896 urging it clockwise against the force of spring 897 and withdrawing finger 894 from tube 804. As best seen in FIG. 33 this movement of lever 870 causes lever 867 to move hook 866 away from lever 864 permitting spring 865 to urge lever 864 clockwise and finger 860 down against tube 820 to pinch it shut. Valve 822 closes before valve 802 opens because hook 866 releases lever 864 before hook 898 engages lever 896. In addition the raising of frame 630 causes the raising of rollers 702 and members 360 and the consequent elevation of discharge members 302 and 304 (FIG. 13).

At this juncture, crank 654 (FIGS. 27 and 31A) and roller 655 permit spring 491 to retract arms 480 and 482 causing the reversal of the direction of movement of racks 416 and 468 (FIG. 27) already described and consequently returning carrier members 386 back to their original positions with rollers 384 in their elevated position as detailed above. As the carrier 386 most remote from syringe 810 (FIG. 12) moves to the right back to its original position, pin follower 926 urges lever 914 to pivot counterclockwise along with block 918 against the force of spring 928 causing the movement of pin 910 to the right in slot 912 and the consequent movement of block 904 and plunger 812 of syringe 810 to the right causing syringe 810 to receive blood from container 806 through line 804 (valve 802 being open and valve 822 being closed).

The condition of the parts during this returning movement is illustrated by stages C and D in FIG. 2.

When arms 480 and 482 have returned to their original positions cam 650 permits spring 648 to raise member 647 and return frame 630 to its original position and thus returning valve fingers 712, 714, 720 and 722 and valves 802 and 822 to their neutral positions. Similarly discharge members 302 and 304 and the rollers 384 are lowered to their original positions.

The above cycle of operation is repeated until full operation is to be started in order to prevent hardening of the mixture of culture medium and blood in any of the parts and to warm up the tubes through which the mixture flows.

Paddles 50 are placed on ring 20 by hand upstream of filling station 160 with the tip end of each paddle in block 60 and the handle on bar 72 (FIG. 8). With pumping stations 160 and 162 now ready for full operation, switches 2172 and 2176 are opened and switches 2134 and 2136 are closed causing motors 653 and 653' to operate intermittently as described above. Switch 2010 is now closed to initiate action of motor 44 as previously fully described.

Motor 44 (FIG. 5) drives belt 42 which in turn operates speed reducer 40 which drives a shaft 34 which in turn drives a train of gears 32, 30, 28 and 26. Gear 26 drives pinion 24 which drives ring gear 22 on ring 20.

Lever 108 (FIG. 6) being in engagement with ring gear 22, frame 102 is pivoted about shaft 104 along with ring 20.

Prior to the movement of reciprocating carriage 166 (FIG. 12), shaft 34 rotates cam 508 (FIG. 27) into engagement with cam follower 506 to provide slide 504 with a short quick movement away from the center of ring 20. This moves rod 502 which pivots bell crank lever 498 about pin 500 causing adjustable tappet 493 on the end of rod 492 to advance arms 480 and 482 a short distance which in turn moves the racks 468 and 416 a short distance to the right as viewed in FIG. 27 causing a short advance of carriers 386 and rollers 384 against tubes 374 through the mechanism previously described in connection with the purging operation. This compensates for the displacement in the tubes 374 resulting from the opening of valves 712, 714, 720 and 722. This insures immediate discharge of the culture medium-blood liquid into the cavity 54 of each paddle 50 adjacent the head end thereof to insure complete filling of this end for each cavity 54 lying below the discharge nozzles 306 and 308 (FIG. 20) of fluid discharge members 302 and 304 which at this juncture lie immediately above the head end of each cavity 54, respectively, as shown in FIGS. 17 and 18. Advantageously, tappet 493 is adjusted so that there is an initial discharge of the liquid into the paddle cavity by this action. After about 270° of rotation of cam 508 (FIG. 27) it is contoured to permit cam follower 506 and racks 416 and 468 to be moved back to their initial positions by spring 491 where they are ready for the next booster operation at the start of a new cycle.

At this stage fluid discharge members 302 and 304 (FIG. 3) are tracking above a pair of paddles 50 carried by ring 20 since these members 302 and 304 are being carried along with frame 102 which is engaged with the ring 20 and supports reciprocating carriage 166. Immediately after the booster action just described, the movement of carriage 166 towards the center of ring 20 is initiated. Shaft 34 rotates cam 202 (FIG. 16) which causes cam follower 204, arm 206 and rack 212 to move in the direction of the center of ring 20 with rack 212 rotating gear 222 on shaft 224 which in turn rotates gear 226 which moves rack 228, rod 240 and spring 246 to the left as viewed in FIG. 16 to advance front plate 173 of carriage 166 and hence carriage 166 towards the center of ring 20. This causes the fluid discharge members 302 and 304 to each advance their discharge nozzles 306 and 308 along the length of the respective paddle cavities 54. By virtue of the follower 364 (FIGS. 23A and 23B) being advanced between strips 363, 363 each arm 358 and standards 356 and 332 are pivoted about the center of sleeve 360 an amount to cause the respective discharge member to track along a radial so as to be maintained immediately above the respective paddle cavity 54 as the discharge members 302 and 304 are advanced by virtue of their being secured to carriage 166. As indicated by the construction lines 363A and 363B the center lines of the pairs of tracks 363, 363 associated with members 302 and 304 point to the center of ring 20. Since the discharge members are directly over the respective followers 364, 364 the members 302 and 304 must follow above the cavity 54 of their respective paddles 50 even though the carriage 166 travels on a radial lying between the radials on which the two paddles lie.

As the carriage 166 advances towards the center of ring 20, stub shaft 417 (FIG. 23C) which is secured to carriage 166 carries sleeve 412 and sleeve 460 and their associated gears 414 and 466, respectively. Racks 416 and 468 being held against movement since arms 480 and 482 are held against movement by the interaction of cam 508 and follower 506 (FIG. 27), gears 414 and 466 are caused to rotate by their relative movement with respect to racks 416 and 468, respectively, cuasing the rotation of sleeves 412 (FIG. 23C) and 460 and their gears 410 and 458, respectively, to actuate racks 392 and 452 and advance the roller carriers 386, 386. This causes the culture fluid to be discharged into the paddle cavities 54 as rollers 384 are advanced over tubes 374 and the discharge members 302 and 304 are moved along the length of the cavities 54 in order to insure the complete filling of the cavities.

Again, as in the purging operation as push pin 926 (FIG. 12) moves away from level 914 the lever is pivoted by spring 928 causing syringe 810 to discharge blood received from tube 804 into tube 820 for mixture with the culture medium from tube 826 in mixing tube 830 and thence through tube 842, manifold 376 into tubes 374 behind rollers 384 due to the reduced pressure in tubes 374 caused by the rollers 384 displacing the liquid therein.

The carriage 166 continues to advance until the fluid discharge members 302 and 304 arrive at positions over the ends of their associated paddle cavities closer to the center of the ring at which point the high point of cam 202 (FIG. 16) has been reached preventing any further advance of carriage 166. At this juncture cam 674 (FIG. 29) on shaft 34 moves cam follower 672 advancing slider 668 and rod 666 away from the center of ring 20 causing lever 658 to pivot about pin 660 and to lower rod 657A (FIG. 31). Pin 657 on rod 657A engages member 647 causing downward movement of member 647 and rod 646 against the force of spring 648. As previously described in connection with the initial purging, lever 642 is pivoted causing the elevation of lifting frame 630, the closing of valves 712,, 714, 720 and 722 (FIG. 12), the opening of valve 802 and the closing of valve 822 (FIG. 12). It also causes each follower pin 616 (FIG. 14) to pivot its associated lever 604 to cause the elevation of rollers 384 to permit the passage of liquid in tubes 374 underneath rollers 384. As lifting frame 630 is elevated it raises roller 702 (FIG. 13) up causing the elevation of sleeve 360, arm 358, standards 356 and 332, rod 330 and discharge members 302 and 304 to clear the liquid in the filled paddles and clear the following paddles on ring 20.

Cam 202 (FIG. 16) now permits spring 204A to move cam follower 204 away from the center of ring 20 causing a reversal in the direction of movement of racks 212, gear 222, shaft 224, gear 226, rack 228, rod 240 and spring 246 which causes carriage 166 to be returned to its original position and due to the relative movement between racks 416 and 468 with gears 414 and 466, respectively, and the associated mechanism the carriers 386 are returned to their original positions. Again, follower pin 926 (FIG. 12) pushes against lever 914 causing syringe 810 to take in blood from container 806 through line 804. When the carriage 166 returns to its fully retracted position, cam 674 (FIG. 29) acts to permit follower 672 to move towards the center of ring 20 under the impetus of spring 648 as described previously causing lever 658 to pivot about pin 660 so as to cause the elevation of rod 657A (FIG. 31A), pin 657, member 647 and rod 646 to pivot lever 642 to lower lifting frame 630 to its original position with the consequent lowering of rollers 384 onto tubes 374 incident to the lowering of levers 618 and follower pins 616 (FIG. 14). The lowering of frame 630 also results in the opening of valves 712, 714, 720, 722 (FIG. 12), the closing of valve 802 and the opening of valve 822 (FIG. 12). Also roller 702 (FIG. 13) is lowered to lower the discharge members 302 and 304.

Figure 6:
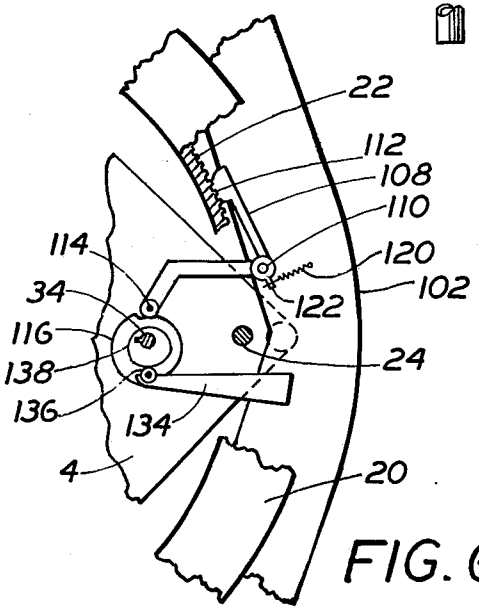
FIG. 6 is a top plan view, partially broken away, showing the mechanism of oscillating the oscillating frame shown in FIG. 5.

At the commencement of the retraction of the carriage 166 shaft 34 rotates cam 116 (FIG. 6) to cause cam follower 114 to pivot lever 108 so as to disengage teeth 112 from ring gear 22 and then shaft 34 rotates cam 138 (FIG. 6) to move cam follower 136 in a direction away from shaft 34 to cause arm 134 and hence frame 102 to move clockwise as viewed in FIG. 6 in order to get into position for another paddle filling cycle. Frame 102 is moved clockwise until discharge members 302 and 304, respectively, are respectively over the next two paddles to be filled at which time cam 116 permits the spring 120 to pivot lever 108 to engage teeth 112 with ring gear 22 to cause frame 102 to move with ring 20. At this point the pumping station 160 is now ready for a new cycle of operation. As indicated previously the operation of pumping station 162 is precisely the same as the operation of pumping station 160 described above. The pumping station 162 is utilized when it is desired to fill a second cavity 56 on the underside of paddle 50. To accomplish this the paddles must be turned over after their cavities 54 are filled by pumping station 160. This operation will now be described.

A paddle turn over mechanism 1002 (FIG. 3) as best seen in FIG. 35 is secured to frame 102 so as to oscillate therewith in the same manner as carriage 166 and associated mechanism. At the commencement of a cycle of operation turn over mechanism 1002 has its pair of turning members 1012 (FIG. 36) with each having a paddle handle 70 received in its slot 1014. As mechanism 1002 is advanced with frame 102, slide 1008 is moved upwardly to cause turning members 1012 to raise handles 70 to a position where they are free to turn clear of support bar 72 by virtue of shaft 34 rotating cam 1148 (FIG. 37) to move cam follower 1146 downwardly, pivoting lever 1144 downwardly and rotating rod 1140 to cause levers 1134 and 1136 to move upwardly elevating plate 1132 (FIG. 35), roller 1130 and hence slide 1008 (FIG. 35). Immediately thereafter cam 1050 (FIG. 37) rotated by shaft 34 forces cam follower 1052 and hence lever 1054 outwardly causing pivoting at 1060 and causing the movement of lever 1064 to rotate ratchet lever 1068 and pawl 1072 (FIG. 38) to drive wheel 1080 and hence angle drive 1092 which in turn through shaft 1100 (FIG. 37), sprocket 1102, chain 1104, sprocket 1106 and stub shaft 1108, shaft 1110 and shaft 1038 drives chain 1028 (FIG. 35) to rotate sprockets 1016 and 1024 and hence shafts 1010 and 1020, respectively, to cause the rotation of the two turning members 1012 180° to turn the paddle members 50 over and expose the cavities 56 on their undersides.

As best seen in FIG. 38 detent 1086 engaging an opening 1082 acts to keep wheel 1080 stabilized at the neutral position. After the paddles have been turned over, the rotation of cam 1148 (FIG. 37) permits cam follower 1146 to be elevated by virtue of the weight of slide 1008 moving downwardly to its original position and causing a pivoting of shaft 1140 and elevation of lever 1144. Cam 1050 permits spring 1056 to return lever 1054 to its original position causing pawl 1072 to be positioned in the next opening 1082 and ready to rotate wheel 1080 again.

Since the mechanism for lifting slide 1008 does not oscillate with plate 102, plate 1132 is of sufficient width to accommodate the movement of roller 1130 relative thereto (FIG. 35). The turn over mechanism 1002 is carried clockwise when frame 102 moves clockwise as previously described, until it is positioned with the next two adjacent paddles in the slots 1014 of the turning members 1012.

The turned over paddles retain the culture medium liquid in the underside cavities because the culture medium has solidified sufficiently.

The upturned cavities 56 are then filled with culture medium by filling station 162. After cavity 56 of a paddle 50 is filled, the paddle 50 is carried by ring 20 while the culture medium in cavity 56 solidifies. Each paddle 50 is removed by hand at a point about opposite the second filling station 162.

The above described embodiment is illustrative and is not intended to be limiting.

I claim:

1. A machine for filling an elongated body having an elongated cavity extending along its length with a liquid comprising:

a ring for supporting a plurality of bodies with their cavities extending across the ring, means to continuously rotate the ring, filling means including a discharge member to deliver a solidifiable liquid to fill the cavity of a body on the ring, and positioning means to repeatedly move the discharge member to follow a body as it is carried by the ring and to move along the length of the cavity during filling and to return said discharge member to its original position for a new filling operation in order to spread the liquid throughout the length of the cavity.

2. A machine in accordance with claim 1 having means to lower the lower end of the discharge member to a position adjacent the cavity prior to the filling and to raise the discharge member immediately after the filling to clear the liquid in the cavity.

3. A machine in accordance with claim 1 having:

means to oscillate the discharge member about the axis of the ring to cause the discharge member to follow a body being carried by the ring during the filling and to return the discharge member to its original angular position, and means to move the discharge member towards the center of the ring as the discharge member follows a body to cause the discharge member to move along the length of the cavity and to move the discharge member in a direction away from the center of the ring after the filling.

4. A machine in accordance with claim 1 in which the filling means has a second discharge member for simultaneously filling the cavity of a second body, and the positioning means reciprocates on a radial of the ring lying between the bodies to be filled and having means to adjust the position of the discharge members to cause them to follow the radials of the bodies they fill.

5. A machine in accordance with claim 1 having:

means to oscillate the discharge member about the axis of the ring to cause the discharge member to follow a body being carried by the ring during the filling and to return the discharge member to its original angular position, means to move the discharge member towards the center of the ring as the discharge member follows a body to cause the discharge member to move along the length of the cavity during filling and to move the discharge member in a direction away from the center of the ring after the filling, and means to lower the discharge member to a position adjacent the cavity prior to the filling and to raise the discharge member after the filling to clear the liquid in the cavity.

6. A machine in accordance with claim 3 in which the means to oscillate the discharge member has latch means to engage the ring to cause the discharge member to move with the ring during filling and cam actuated means to return the discharge member to its original position after filling.

7. A machine in accordance with claim 3 in which the means to move the discharge member towards and away from the center of the ring includes a cam.

8. A machine in accordance with claim 3 in which the means to move the supports toward and away from the center of the ring includes a carriage supporting the discharge member, means mounting the carriage for reciprocal movement towards and away from the center of the ring, and cam actuated means for reciprocating the carriage.

9. A machine in accordance with claim 3 in which the means to oscillate the discharge member has latch means to engage the ring to cause the discharge member to move with the ring during filling and cam actuated means to return the discharge member to its original position after filling, and in which the means to move the discharge member towards and away from the center of the ring includes a cam.

10. A machine in accordance with claim 1 in which the filling means includes:

a reservoir of liquid, a resilient tube communicating with the discharge member and the reservoir of liquid, a plate supporting a portion of the tube, and means to compress said portion of the tube progressively to advance liquid to the discharge member for filling the body cavity and draw liquid into the tube from the reservoir.

11. A machine in accordance with claim 10 in which the means to compress the tube has a roller, means to advance the roller along the said portion of the tube during filling and retract the roller after filling and means to maintain the roller pressed against the tube during the advance of the roller and to elevate it prior to retraction of the roller, and valve means controlling the tube to prevent liquid in the tube from flowing to the reservoir when the roller is elevated.

12. A machine in accordance with claim 1 in which the positioning means includes:

a support for the discharge member, a carriage mounting the support for the discharge member, means slidably mounting the carriage for reciprocal movement towards and away from the center of the ring to cause the discharge member to move along the length of the cavity during filling, means for reciprocating the carriage, means to oscillate the means mounting the carriage about an axis coaxial with the axis of the ring to cause the discharge member to follow a body being carried by the ring during filling and to return the discharge member to its original angular position, a plate mounted on the carriage, a reservoir for liquid, a resilient tube communicating with the discharge member and the reservoir for the liquid, a portion of the tube running on said plate, a roller carrier mounted on said carriage for reciprocal movement relative to the tube in the direction of the run of the tube, a roller mounted on said roller carrier above the tube, means to reciprocate the roller carrier, means to cause the roller to press against the tube prior to the advance of the roller carrier to pump liquid to the discharge member and pull liquid from the reservoir into the tube and to maintain the roller in an elevated position as the roller carrier retracts, and valve means controlling the tube to prevent liquid flowing towards the reservoir when the rollers are in the elevated position.

13. A machine in accordance with claim 1 in which the positioning means includes:

a support for the discharge member, a carriage mounting the support for the discharge member, means slidably mounting the carriage for reciprocal movement towards and away from the center of the ring to cause the discharge member to move along the length of the cavity during filling, means for reciprocating the carriage, means to oscillate the means mounting the carriage about an axis coaxial with the axis of the ring to cause the discharge member to follow a body being carried by the ring during filling and to return the discharge member to its original angular position, a plate mounted on the carriage, a reservoir for liquid, a resilient tube communicatng with the discharge member and the reservoir for the liquid, a portion of the tube running on said plate, a roller carrier mounted on said carriage for reciprocal movement relative to the tube in the direction of the run of the tube, a roller mounted on said roller carrier above the tube, means responsive to movement of the carriage to advance and retract the roller carrier, means to cause the roller to press against the tube prior to the advance of the roller carrier to pump liquid to the discharge member and pull liquid from the reservoir into the tube and to maintain the roller in an elevated position as the roller carrier retracts, means to advance the roller carrier a short distance compared to its entire advance after the roller is pressed against the tube and prior to the first mentioned advance of the roller carrier to insure the tube is full of liquid in advance of the roller when the carriage starts its advance, and valve means controlling the tube to prevent liquid flowing towards the reservoir when the rollers are in the elevated position.

14. A machine in accordance with claim 1 in which the positioning means includes:

a support for the discharge member, a carriage mounting the support for the discharge member, means slidably mounting the carriage for reciprocal movement towards and away from the center of the ring to cause the discharge member to move along the length of the cavity during filling, means for reciprocating the carriage, means to oscillate the means mounting the carriage about an axis coaxial with the axis of the ring to cause the discharge member to follow a body being carried by the ring during filling and to return the discharge member to its original angular position, a plate mounted on the carriage, a reservoir for liquid, a resilient tube communicating with the discharge member and the reservoir for the liquid, a portion of the tube running on said plate, a roller carrier mounted on said carriage for reciprocal movement relative to the tube in the direction of the run of the tube, a roller mounted on said roller carrier above the tube, means responsive to movement of the carriage to reciprocate the roller carrier, means to cause the roller to press against the tube prior to the advance of the roller carrier to pump liquid to the discharge member and pull liquid from the reservoir into the tube and to maintain the roller in an elevated position as the roller carrier retracts, means to advance the roller carrier a short distance compared to its entire advance after the roller is pressed against the tube and prior to the first mentioned advance of the roller carrier to insure the tube is full of liquid in advance of the roller when the carriage starts its advance and provide an initial discharge of liquid into the body, a valve controlling the tube, and means to maintain the valve closed when the roller is not pressed against the tube and open when the roller is pressed against the tube.

15. A machine in accordance with claim 1 in which the positioning means includes:

a support for the discharge member, a carriage mounting the support for the discharge member, means slidably mounting the carriage for reciprocal movement towards and away from the center of the ring to cause the discharge member to move along the length of the cavity during filling, means for reciprocating the carriage, means to oscillate the means mounting the carriage about an axis coaxial with the axis of the ring to cause the discharge member to follow a body being carried by the ring during filling and to return the discharge member to its original angular position, a plate mounted on the carriage, a reservoir for liquid, a resilient tube communicating with the discharge member and reservoir for the liquid, a portion of the tube running on said plate, a roller carrier mounted on said carriage for reciprocal movement relative to the tube in the direction of the run of the tube, a roller mounted on said roller carrier above the tube, a rack secured to the roller carrier, a pinion secured to the carriage, means including a shaft secured to the pinion, a second pinion secured to the shaft and a rack to cause the roller carrier to reciprocate on the reciprocation of the carriage, means to cause the roller to press against the tube prior to the advance of the roller carrier to pump liquid to the discharge member and pull liquid from the reservoir into the tube and to maintain the roller in an elevated position as the roller carrier retracts, and valve means controlling the tube to prevent liquid flowing towards the reservoir when the rollers are in the elevated position.

16. A machine in accordance with claim 15 having means to move the second mentioned rack to advance the roller carrier to supply an initial amount of liquid to the discharge member prior to movement of the carriage to insure a uniform discharge of liquid.

17. A machine in accordance with claim 10 in which the means to compress the tube has a roller, means to advance the roller along the said portion of the tube during filling and retract the roller after filling and means to maintain the roller pressed against the tube during the advance of the roller and to elevate it prior to retraction of the roller, and the filling means including a valve controlling the tube between said portion of the tube and the discharge member and means to close the valve before the roller is elevated and to maintain the valve in the closed position while the roller is elevated and in the open position during the advance of the roller.

18. A machine in accordance with claim 17 in which the filling means includes means to mix one liquid with a second liquid as the liquids are supplied to said portion of the tube to provide a mixture of liquids for filling body cavities.

19. A machine in accordance with claim 17 having a second reservoir, pumping means to withdraw liquid from said second reservoir and then discharge the withdrawn liquid into the liquid being withdrawn from the first-mentioned reservoir into the tube.

20. A machine in accordance with claim 11 in which the means to advance and retract the roller comprises a carrier supporting the roller, a rack secured to the carrier, a pinion engaging the rack and means to rotate the pinion in one direction to advance the carrier and in the reverse direction to retract the carrier.

21. A machine in accordance with claim 1 having means spaced from the filling means to turn upside down each body to expose upwardly a second elongated cavity and second filling means to deliver a liquid to the second cavity.

22. A machine in accordance with claim 1 having means spaced from the filling means to turn upside down each body to expose upwardly a second elongated cavity and second filling means substantially the same as the first-mentioned filling means to deliver a liquid to the second cavity.

23. A machine for filling an elongated body having an elongated cavity extending along its length with a solidifiable liquid comprising:

a ring for supporting a plurality of bodies with their cavities extending across the ring, means to continuously rotate the ring, filling means including a discharge member to deliver a solidifiable liquid to fill a cavity of a body on the ring, a support for the discharge member, means to oscillate the support about an axis coaxial with the axis of the ring to cause the discharge member to follow a body being carried by the ring during the filling and to return the discharge member to its original angular position, means to move the support towards the center of the ring during the filling to cause the discharge member to move from one end of the cavity to the other end of the cavity and to move the support away from the center of th ring after the filling, a rotatable member having a substantially horizontal axis mounted adjacent one side of the ring at a position spaced from the filling means and having a slot for the reception of one end of a body on the ring, said rotatable member being mounted on said means to oscillate the said support to cause the rotatable member to follow a body within the confines of said slot and to return the rotatable member to its original position, means to rotate said rotatable member about its axis to turn the body upside down as the rotatable member follows the body to expose upwardly a second elongated cavity in the body, and second filling means to deliver a liquid to said second cavity.

24. A machine in accordance with claim 23 having means to elevate the rotatable means to lift the said one end of the body clear of the ring for free rotation.

25. A machine in accordance with claim 24 in which the elevating means includes a slide and including cam means to raise and lower the slide.

26. The method of filling with a liquid elongated bodies each having an elongated cavity extending along its length and carried by a continuously rotating ring comprising:

causing a nozzle to follow a body as it is carried by the ring and to move along the length of the body cavity, discharging a liquid through said nozzle into the body cavity as the nozzle follows the body, and returning the nozzle to its original position preparatory to the filling of another body cavity.

27. The method of claim 26 in which the liquid is solidifiable.

28. The method of claim 26 in which a predetermined quantity of liquid is supplied to the nozzle by filling a portion of a length of resilient tubing connected to the nozzle with the liquid and progressively compressing a predetermined length of the tubing to discharge through the nozzle a predetermined quantity of liquid.

29. The method of claim 28 in which two liquids are mixed to form the liquid used to fill said portion of the tube, said mixing being carried out substantially immediately before the filling of said portion of the tube.

30. A machine in accordance with claim 11 in which one motor rotates the ring and actuates the means to advance and retract the roller and the means to maintain the roller pressed against the tube and to elevate the roller and means including a second motor is adapted to advance and retract the roller and maintain the roller pressed against the tube during the advance of the roller and to elevate it prior to the retraction of the roller when the first motor is not operating in order to continue the repeated flow of liquid through the discharge member to prevent a solidifiable liquid from solidifying in the tube and discharge member.

31. A machine in accordance with claim 15 having means including a motor to reciprocate the last mentioned rack to advance and retract the roller carrier and actuate the last mentioned means when the machine of claim 15 is shutdown in order to continue the repeated flow of liquid through the discharge member to prevent a solidifiable liquid from solidifying in the tube and discharge member.

* * * * *